US010300993B2

(12) United States Patent
Vandenworm

(10) Patent No.: US 10,300,993 B2
(45) **Date of Patent: *May 28, 2019**

(54) BUOYANT STRUCTURE WITH A PLURALITY OF TUNNELS AND FINS

(71) Applicant: Nicolaas Johannes Vandenworm, Houston, TX (US)

(72) Inventor: Nicolaas Johannes Vandenworm, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/915,346

(22) Filed: Mar. 8, 2018

(65) Prior Publication Data

US 2018/0194438 A1 Jul. 12, 2018

Related U.S. Application Data

(63) Continuation of application No. 15/849,908, filed on Dec. 21, 2017, which is a continuation of application No. 15/821,180, filed on Nov. 22, 2017, which is a continuation-in-part of application No. 15/821,158, filed on Nov. 22, 2017, now Pat. No. 9,969,466, which is a continuation of application No. 15/798,078, filed on Oct. 30, 2017, which is a continuation of application No. 15/705,073, filed on Sep. 14, 2017, which is a continuation of application (Continued)

(51) Int. Cl.

| | |
|---|---|
| ***B63B 21/50*** | (2006.01) |
| ***B63B 39/00*** | (2006.01) |
| *B63B 21/00* | (2006.01) |
| *B63B 35/44* | (2006.01) |
| *B63B 39/02* | (2006.01) |
| *B63B 1/04* | (2006.01) |
| *B63B 39/06* | (2006.01) |

(52) U.S. Cl.

CPC ..... *B63B 21/50* (2013.01); *B63B 39/005* (2013.01); *B63B 1/041* (2013.01); *B63B 39/02* (2013.01); *B63B 2001/044* (2013.01); *B63B 2021/003* (2013.01); *B63B 2035/4473* (2013.01); *B63B 2039/067* (2013.01)

(58) Field of Classification Search

CPC ..... B63B 21/50; B63B 35/44

See application file for complete search history.

(56) References Cited

U.S. PATENT DOCUMENTS

| | | | |
|---|---|---|---|
| 2,156,635 | A | 5/1939 | Mascuch et al. |
| 3,041,639 | A | 7/1962 | Atlas |

(Continued)

FOREIGN PATENT DOCUMENTS

| | | | |
|---|---|---|---|
| WO | WO2009136799 | A1 | 11/2002 |
| WO | WO2012005587 | A1 | 1/2012 |

*Primary Examiner* — Stephen P Avila

(74) *Attorney, Agent, or Firm* — Buskop Law Group, P.C.; Wendy Buskop

(57) ABSTRACT

A buoyant structure has a hull having a main deck, a lower inwardly-tapering frustoconical side section that extends from the main deck, a lower generally round section extending from the lower inwardly-tapering frustroconical side section, a keel having an n-polytope shape, a plurality of separate tunnels between columns extending from the keel having an n-polytope shape and a fin-shaped appendage is secured to a lower and an outer portion of the hull. The at least one tunnel contains water at operational depth of the buoyant structure.

16 Claims, 25 Drawing Sheets

Related U.S. Application Data

No. 15/522,076, filed as application No. PCT/US2015/057397 on Oct. 26, 2015, which is a continuation of application No. 14/524,992, filed on Oct. 27, 2014, which is a continuation-in-part of application No. 14/105,321, filed on Dec. 13, 2013, now Pat. No. 8,869,727, which is a continuation-in-part of application No. 13/369,600, filed on Feb. 9, 2012, now Pat. No. 8,662,000, which is a continuation-in-part of application No. 12/914,709, filed on Oct. 28, 2010, now Pat. No. 8,251,003.

(60) Provisional application No. 61/521,701, filed on Aug. 9, 2011, provisional application No. 61/259,201, filed on Nov. 8, 2009.

(56) References Cited

U.S. PATENT DOCUMENTS

| | | | |
|---|---|---|---|
| 4,282,822 | A | 8/1981 | Jackson |
| 4,446,808 | A | 5/1984 | Colin |
| 4,502,551 | A | 3/1985 | Rule |
| 4,549,835 | A | 10/1985 | Ando et al. |
| 4,606,673 | A | 8/1986 | Daniell |
| 4,640,214 | A | 2/1987 | Bruns |
| 4,679,517 | A | 7/1987 | Kramer |
| 4,984,935 | A | 1/1991 | de Oliveira Filho et al. |
| 5,573,353 | A | 11/1996 | Recalde |
| 6,945,736 | B2 | 9/2005 | Smedel |
| 7,958,835 | B2 * | 6/2011 | Srinivasan ..... B63B 35/44 114/125 |
| 8,251,003 | B2 | 8/2012 | Vandenworm |
| 8,662,000 | B2 | 3/2014 | Vandenworm |
| 9,079,644 | B2 | 7/2015 | Aarsnes |
| 9,340,264 | B2 | 5/2016 | Syvertesen |
| 2009/0126616 | A1 | 5/2009 | Srinivasan |
| 2013/0133563 | A1 | 5/2013 | Kroecker |
| 2015/0175245 | A1 | 6/2015 | Huang |
| 2015/0175246 | A1 | 6/2015 | Huang |
| 2015/0344114 | A1 | 12/2015 | Huang |

* cited by examiner

BUOYANT STRUCTURE WITH A PLURALITY OF TUNNELS AND FINS

CROSS REFERENCE TO RELATED APPLICATIONS

The present application is a Continuation and claims priority to and benefit of co-pending U.S. patent application Ser. No. 15/849,908 filed on Dec. 21, 2017, entitled "BUOYANT STRUCTURE," which is a Continuation and claims priority to co-pending U.S. patent application Ser. No. 15/821,180 filed on Nov. 22, 2017, entitled "METHOD FOR OFFSHORE FLOATING PETROLEUM PRODUCTION, STORAGE AND OFFLOADING WITH A BUOYANT STRUCTURE," and to co-pending U.S. patent application Ser. No. 15/821,158 filed Nov. 22, 2017, entitled "METHOD FOR OPERATING A DRILLER," which is a Continuation in Part and claims priority to co-pending U.S. patent application Ser. No. 15/798,078 filed on Oct. 30, 2017, entitled "FLOATING DRILLER," which is a Continuation of U.S. patent application Ser. No. 15/705,073 filed Sep. 14, 2017, entitled "BUOYANT STRUCTURE," which is a Continuation of U.S. patent application Ser. No. 15/522,076 filed on Apr. 26, 2017, entitled "BUOYANT STRUCTURE," which claims priority to and the benefit of co-pending National Phase Application PCT/US2015/057397 filed on Oct. 26, 2015, entitled "BUOYANT STRUCTURE," which claims priority of U.S. patent application Ser. No. 14/524,992 filed on Oct. 27, 2014, entitled "BUOYANT STRUCTURE," now abandoned, which is a Continuation in Part of issued U.S. patent application Ser. No. 14/105,321 filed on Dec. 13, 2013, entitled "BUOYANT STRUCTURE," issued as U.S. Pat. No. 8,869,727 on Oct. 28, 2014, which is a Continuation in Part of issued U.S. patent application Ser. No. 13/369,600 filed on Feb. 9, 2012, entitled "STABLE OFFSHORE FLOATING DEPOT," issued as U.S. Pat. No. 8,662,000 on Mar. 4, 2014, which is a Continuation in Part of issued U.S. patent application Ser. No. 12/914,709 filed on Oct. 28, 2010, entitled "OFFSHORE BUOYANT DRILLING, PRODUCTION, STORAGE AND OFFLOADING STRUCTURE," issued as U.S. Pat. No. 8,251,003 on Aug. 28, 2012, which claims the benefit of U.S. Provisional Patent Application Ser. No. 61/259,201 filed on Nov. 8, 2009, entitled "DRILLING, PRODUCTION, STORAGE AND OFFLOADING VESSEL,", and U.S. Provisional Patent Application Ser. No. 61/262,533 filed on Nov. 18, 2009; entitled "DRILLING, PRODUCTION, STORAGE AND OFFLOADING VESSEL,", and claims the benefit of U.S. Provisional Patent Application Ser. No. 61/521,701 filed on Aug. 9, 2011, entitled "FLOTEL OFFSHORE PLATFORM". These references are hereby incorporated in their entirety.

FIELD

The present embodiments generally relate to a buoyant structure for supporting offshore oil and gas operations having a plurality of tunnels and fins.

BACKGROUND

A need exists for a buoyant structure that provides kinetic energy absorption capabilities with a plurality of tunnels formed in the buoyant structure.

A further need exists for a buoyant structure that provides wave damping and wave breakup within a plurality of tunnels formed in the buoyant structure.

The present embodiments meet these needs.

BRIEF DESCRIPTION OF THE DRAWINGS

The detailed description will be better understood in conjunction with the accompanying drawings as follows:

FIGS. 17A-7E depicts different embodiments of the keel extensions.

Figure 1:
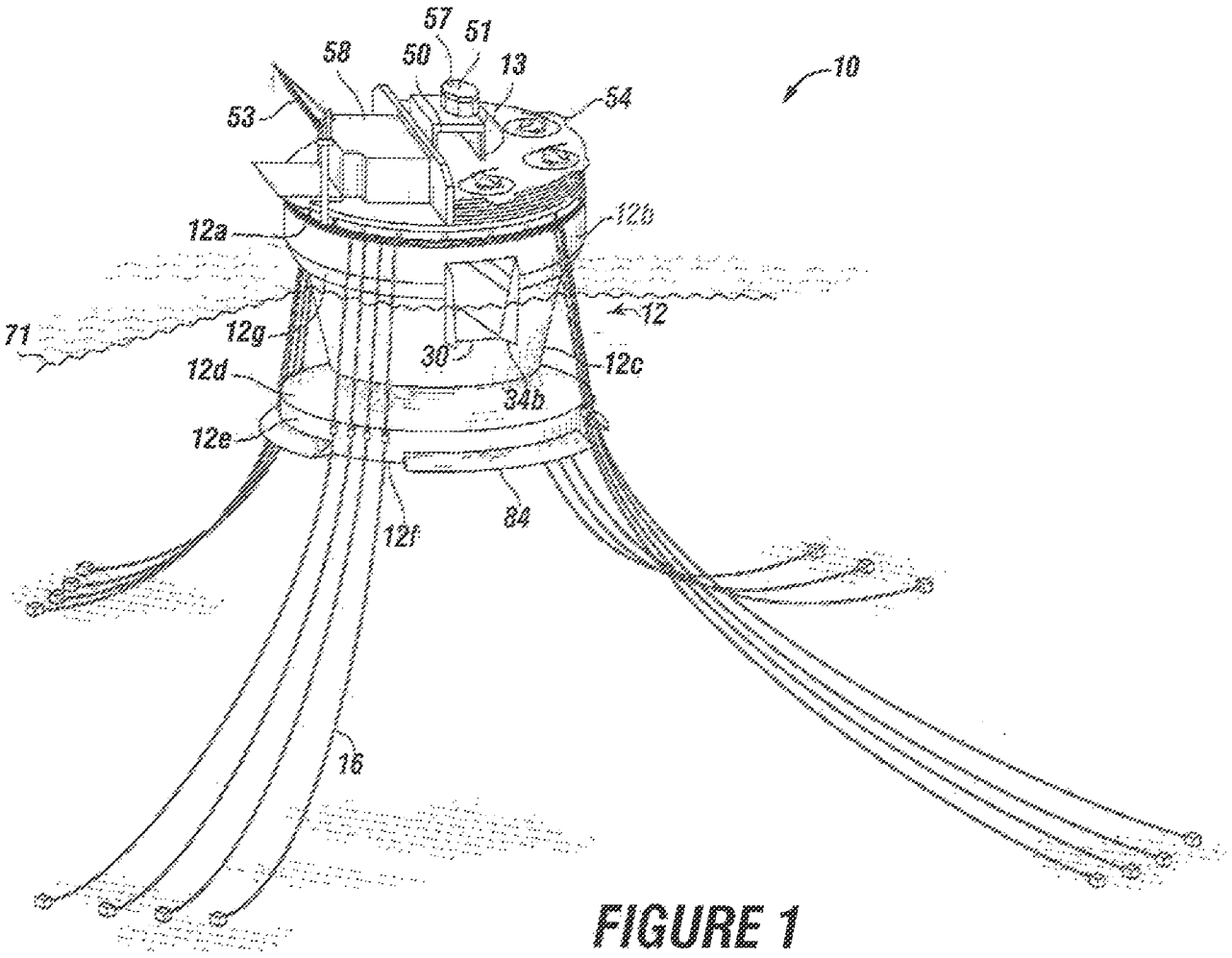
FIG. 1 is a perspective view of a buoyant structure.

The present embodiments are detailed below with reference to the listed Figures.

DETAILED DESCRIPTION OF THE EMBODIMENTS

Before explaining the present apparatus in detail, it is to be understood that the buoyant structure is not limited to the particular embodiments and that it can be practiced or carried out in various ways.

The present embodiments relate to a buoyant structure for supporting offshore oil and gas operations.

The buoyant structure of this invention can be used as a stable platform to accommodate wind towers with turbines for producing green energy offshore.

The buoyant structure of this invention can be used for ocean garbage collection, such as large quantities of plastics which accumulate at sea in "dead zones".

The buoyant structure of this invention can be used for waste management.

The buoyant structure of this invention can be used for hydrocarbon drilling and hydrocarbon production and workovers at sea as a driller, a floating production and storage unit offshore, an FPU, as well as resting on a seabed in shallow water.

The embodiments relate to a buoyant structure with a hull, a main deck, a lower inwardly-tapering frustoconical side section; a lower generally round section extending from the lower inwardly-tapering frustroconical side section; a keel having an n-polytope shape; a fin-shaped appendage secured to a lower and an outer portion of the exterior of the keel having an n-polytope shape, the fin shaped appendages having a shape selected from the group consisting of: a pair of humps and a pair of triangular projections.

In embodiments, the keel has a first plurality of parallel frames extending from the keel and a first keel extension connected to a plurality of parallel frames mounted in parallel with the keel having an n-polytope shape.

The embodiments with tunnels enable safe entry of a watercraft into a buoyant structure in both harsh and benign offshore water environments, with 4 foot to 40 foot seas.

The embodiments employ a plurality of tunnels, wherein the plurality of tunnels contain water at operational depths.

The embodiments prevent injuries to personnel from equipment falling off the buoyant structure by providing a tunnel to contain and protect watercraft for receiving personnel within the buoyant structure.

The embodiments provide a buoyant structure located in an offshore field that enables a quick exit from the offshore structure by many personnel simultaneously, in the case of an approaching hurricane or tsunami.

The embodiments provide a means to quickly transfer many personnel, such as from 200 to 500 people safely from an adjacent platform on fire to the buoyant structure in less than 1 hour.

The embodiments enable the offshore structure to be towed to an offshore disaster and operate as a command center to facilitate in the control of a disaster, and can act as a hospital, or triage center.

The invention relates to a buoyant structure with a hull and a main deck. The hull has a lower inwardly-tapering frustoconical side section that extends from the main deck.

The hull has a lower generally round section extending from the lower inwardly-tapering frustroconical side section and a keel having an n-polytope shape.

The buoyant structure has a plurality of separate tunnels formed in the hull.

The plurality of separate tunnels are configured to contain water at operational depth of the buoyant structure.

The buoyant structure has a fin-shaped appendage 84 secured to a lower and an outer portion of the hull.

In embodiments, the hull has an upper cylindrical side section extending from the main deck engaging the lower inwardly-tapering frustoconical side section.

In embodiments, the buoyant structure has a cylindrical neck connected between the lower inwardly-tapering frustoconical side section and the lower generally round section.

In embodiments, the fin-shaped appendage can have a shape selected from the group consisting of: triangular shape, a hump, and a pair of connected triangular projections. The fin-shaped appendages can be a plurality of appendages, such as a pair of triangles, or a pair of humps.

In additional embodiments, the hull can be ballasted to move between a transport depth and an operational depth, and during transport or operation, the fin-shaped appendage is configured to dampen movement of the buoyant structure as the buoyant structure moves in water.

In embodiments, the buoyant structure has columns extending or producing from the keel having an n-polytope shape. The columns can parallel the central axis of the buoyant structure in embodiments.

In some variations of the buoyant structure, a group of the columns can be cylindrical.

In other variations of the buoyant structure a group of the columns can have equal heights.

Tunnels can be formed between the groups of columns in embodiments. The tunnels can be asymmetrically formed on the keel having an n-polytope shape, such as a toroidal polyhedron. The tunnels can be symmetrically formed on the keel having an n-polytope shape, which looks like a 3 dimensional donut.

The tunnels can be asymmetrical in relationship to the keel having an n-polytope shape or asymmetrical shape between the columns.

The tunnels can be symmetrical in relationship to the keel having an n-polytope shape or symmetrical shape between the columns.

For some variations of the invention, each column has a combination of inward frustroconical flat panels and outward frustroconical flat panels. The angle of inclination can range from 2 degrees to 85 degrees and all the degrees in between.

Other embodiments of the buoyant structure contemplate that each column can have an outer wall having a shape that is curved, or "generally round" as defined herein as "C shaped".

In use, both tunnels can contain water at operational depth, or one tunnel can contain water while the other tunnel is dry.

In other embodiments, one tunnel can be dry at transit depth.

The term "generally round" refers to shapes that appear to have an overall round-like shape, or may be suggestive of an overall round or suggestive of an overall generally round shape. The term "generally round" includes shapes that suggest a curvature, including generally round shapes, circular shapes, and a combination of these shapes. As an example, a series of polygonal shapes formed in a circle shape separated by vacant space would be considered as "generally round".

The term "nearly fully enclosed tubular channel" can be defined as a tubular channel that is 80 percent to 90 percent enclosed.

The term "n-polytope" refers to three dimensional objects which can have straight sides connected together. A polytope is a geometric object with "flat" sides. It is a generalization in any number of dimensions of the three-dimensional polyhedron. Polytopes may exist in any general number of dimensions n as an n-dimensional polytope or n-polytope. Flat sides mean that the sides of a (k+1)-polytope consist of k-polytopes that may have (k−1)-polytopes in common. For example, a two-dimensional polygon is a 2-polytope and a three-dimensional polyhedron is a 3-polytope. The hull shape in embodiments takes the form on an n-polytope with one or more sides opening allowing entrance into the three dimensional structure. In embodiments, toroidal polyhedrons are usable as the shape of the buoyant structure.

Turning now to the Figures, FIG. 1 depicts a buoyant structure 10 for operationally supporting offshore exploration, drilling, production, and storage installations according to an embodiment of the invention.

The buoyant structure 10 can include a hull 12, which can carry a superstructure 13 thereon. The superstructure 13 can include a diverse collection of equipment and structures, such as living quarters and crew accommodations 58, equipment storage, a heliport 54, and a myriad of other structures, systems, and equipment, depending on the type of offshore operations to be supported. Cranes 53 can be mounted to the superstructure. The superstructure can include an aircraft hangar 50. A control tower 51 can be built on the superstructure. The control tower can have a dynamic position system 57.

The hull 12 can be moored to the seafloor by a number of catenary mooring lines 16.

The buoyant structure 10 can have a tunnel 30 with a tunnel opening in the hull 12 to locations exterior of the tunnel.

The tunnel 30 can receive water while the buoyant structure 10 is at an operational depth 71.

The buoyant structure can have a unique hull shape.

Figure 2:
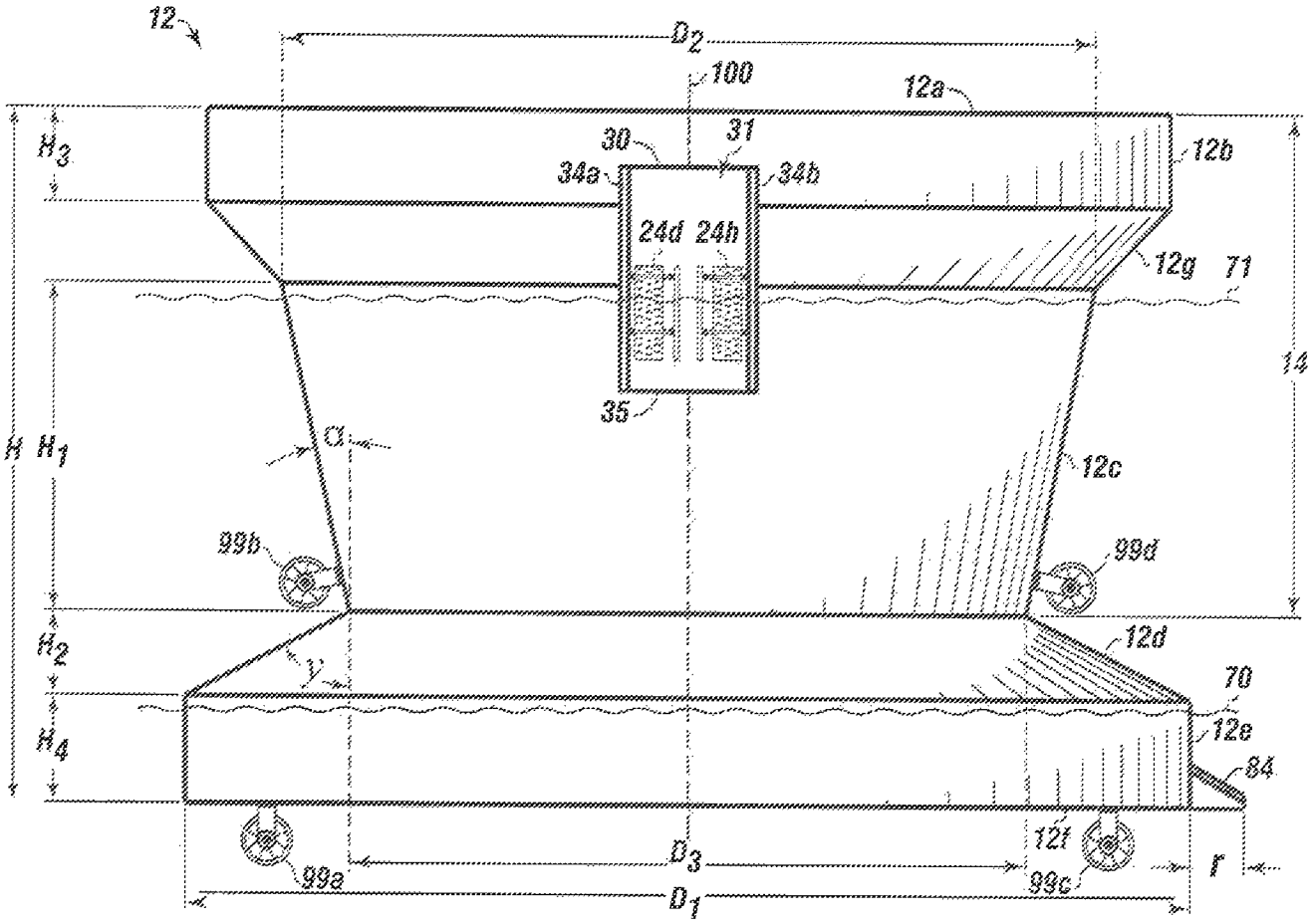
FIG. 2 is a vertical profile drawing of the hull of the buoyant structure.

Referring to FIGS. 1 and 2, the hull 12 of the buoyant structure 10 can have a main deck 12*a*, which can be circular; and a height H. Extending downwardly from the main deck 12*a* can be an upper frustoconical portion 14.

In embodiments, the upper frustoconical portion 14 can have an upper cylindrical side section 12*b* extending downwardly from the main deck 12*a*, an inwardly-tapering upper frustoconical side section 12*g* located below the upper cylindrical side section 12*b* and connecting to a lower inwardly-tapering frustoconical side section 12*c*.

The buoyant structure 10 also can have a lower frustoconical side section 12*d* extending downwardly from the lower inwardly-tapering frustoconical side section 12*c* and flares outwardly. Both the lower inwardly-tapering frustoconical side section 12*c* and the lower frustoconical side section 12*d* can be below the operational depth 71.

A lower generally round section 12*e* can extend downwardly from the lower frustoconical side section 12*d*, and have a matching keel having an n-polytope shape 12*f*.

The lower inwardly-tapering frustoconical side section 12*c* can have a substantially greater vertical height H1 than lower frustoconical side section 12*d* shown as H2. Upper cylindrical side section 12*b* can have a slightly greater vertical height H3 than lower generally round section 12*e* shown as H4.

As shown, the upper cylindrical side section 12*b* can connect to inwardly-tapering upper frustoconical side section 12*g* so as to provide for a main deck of greater radius than the hull radius. The superstructure 13, can be round, square or another shape, such as a half moon. Inwardly-tapering upper frustoconical side section 12*g* can be located above the operational depth 71.

The tunnel 30 can have at least one closable door 34*a* and 34*b* that alternatively, or in combination, can provide for weather and water protection to the tunnel 30.

Fin-shaped appendages 84 can be attached to a lower and an outer portion of the exterior of the hull.

The hull 12 is depicted with a plurality of catenary mooring lines 16 for mooring the buoyant structure to create a mooring spread, 12 are shown but from 3 to 24 can be used.

FIG. 2 is a simplified view of a vertical profile of the hall according to an embodiment.

The tunnel 30 can have a plurality of dynamic movable tendering mechanisms 24*d* and 24*h* disposed within and connected to the tunnel sides.

In an embodiment, the tunnel 30 can have closable doors 34*a* and 34*b* for opening and closing the tunnel opening 31.

The tunnel floor 35 can accept water when the buoyant structure is at an operational depth 71.

Two different depths are shown, the operational depth 71 and the transit depth 70.

The dynamic movable tendering mechanisms 24*d* and 24*h* can be oriented above the tunnel floor 35 and can have portions that are positioned both above the operational depth 71 and extend below the operational depth 71 inside the tunnel 30.

The main deck 12*a*, upper cylindrical side section 12*b*, inwardly-tapering upper frustoconical side section 12*g*, lower inwardly-tapering frustoconical side section 12*c*, lower frustoconical side section 12*d*, lower generally round section 12*e*, and matching keel having an n-polytope shape 12*f* are all co-axial with a common vertical axis 100. In embodiments, the hull 12 can be characterized by a generally round cross section when taken perpendicular to the vertical axis 100 at any elevation.

Due to the generally round planform, the dynamic response of the hull 12 is independent of wave direction (when neglecting any asymmetries in the mooring system, risers, and underwater appendages), thereby minimizing wave-induced yaw forces. Additionally, the conical form of the hull 12 is structurally efficient, offering a high payload and storage volume per ton of steel when compared to traditional ship-shaped offshore structures. The hull 12 can have generally round walls which are generally round in radial cross-section, but such shape may be approximated using a large number of flat metal plates rather than bending plates into a desired curvature. Although a generally round hull planform is preferred, a polygonal hull planform can be used according to alternative embodiments.

In embodiments, the hull 12 can be circular, oval or elliptical forming the generally round planform.

An elliptical shape can be advantageous when the buoyant structure is moored closely adjacent to another offshore platform so as to allow gangway passage between the two structures. An elliptical hull can minimize or eliminate wave interference.

The specific design of the lower inwardly-tapering frustoconical side section 12*c* and the lower frustoconical side section 12*d* generates a significant amount of radiation damping resulting in almost no heave amplification for any wave period, as described below.

Lower inwardly-tapering frustoconical side section 12*c* can be located in the wave zone. At operational depth 71, the waterline can be located on lower inwardly-tapering frustoconical side section 12*c* just below the intersection with upper cylindrical side section 12*b*. Lower inwardly-tapering frustoconical side section 12*c* can slope at an angle with respect to the vertical axis 100 that varies from 10 degrees to 15 degrees. The inward flare before reaching the waterline significantly dampens downward heave, because a downward motion of the hull 12 increases the waterplane area. In other words, the hull area normal to the vertical axis 100 that breaks the water's surface will increase with downward hull motion, and such increased area is subject to the opposing resistance of the air and or water interface. It has been found that 10 degrees to 15 degrees of flare provides a desirable amount of damping of downward heave without sacrificing too much storage volume for the vessel.

Similarly, lower frustoconical side section 12*d* dampens upward heave. The lower frustoconical side section 12*d* can be located below the wave zone (about 30 meters below the waterline). Because the entire lower frustoconical side section 12*d* can be below the water surface, a greater area (normal to the vertical axis 100) is desired to achieve upward damping. Accordingly, the first diameter D1 of the lower hull section can be greater than the second diameter D2 of the lower inwardly-tapering frustoconical side section 12*c*. The lower frustoconical side section 12*d* can slope at an angle (with respect to the vertical axis 100 that ranges from 55 degrees to 65 degrees.) The lower section can flare outwardly at an angle greater than or equal to 55 degrees to provide greater inertia for heave roll and pitch motions. The increased mass contributes to natural periods for heave pitch and roll above the expected wave energy. The upper bound of 65 degrees is based on avoiding abrupt changes in stability during initial ballasting on installation. That is, lower frustoconical side section 12*d* can be perpendicular to the vertical axis 100 and achieve a desired amount of upward heave damping, but such a hull profile would result in an undesirable step-change in stability during initial ballasting on installation. The connection point between upper frustoconical portion 14 and the lower frustoconical side section 12*d* can have a third diameter D3 smaller than the first and second diameters D1 and D2.

The transit depth 70 represents the waterline of the hull 12 while it is being transited to an operational offshore position. The transit depth is known in the art to reduce the amount of energy required to transit a buoyant vessel across distances on the water by decreasing the profile of buoyant structure which contacts the water. The transit depth is roughly the intersection of lower frustoconical side section 12*d* and lower generally round section 12*e*. However, weather and wind conditions can provide need for a different transit depth to meet safety guidelines or to achieve a rapid deployment from one position on the water to another.

The term "buoyant structure" refers to a floating vessel with a low center of gravity providing an inherent positive stability.

The term "low center of gravity" refers to a center of gravity that is positive when compared to metacentric height of a buoyant vessel.

The buoyant structure aggressively resists roll and pitch and is said to be "stiff." Stiff vessels are typically characterized by abrupt jerky accelerations as the large righting moments counter pitch and roll. However, the inertia associated with the high total mass of the buoyant structure, enhanced specifically by the fixed ballast, mitigates such accelerations. In particular, the mass of the fixed ballast increases the natural period of the buoyant structure to above the period of the most common waves, thereby limiting wave-induced acceleration in all degrees of freedom.

In an embodiment, the buoyant structure can have thrusters 99*a*-99*d*.

Figure 3:
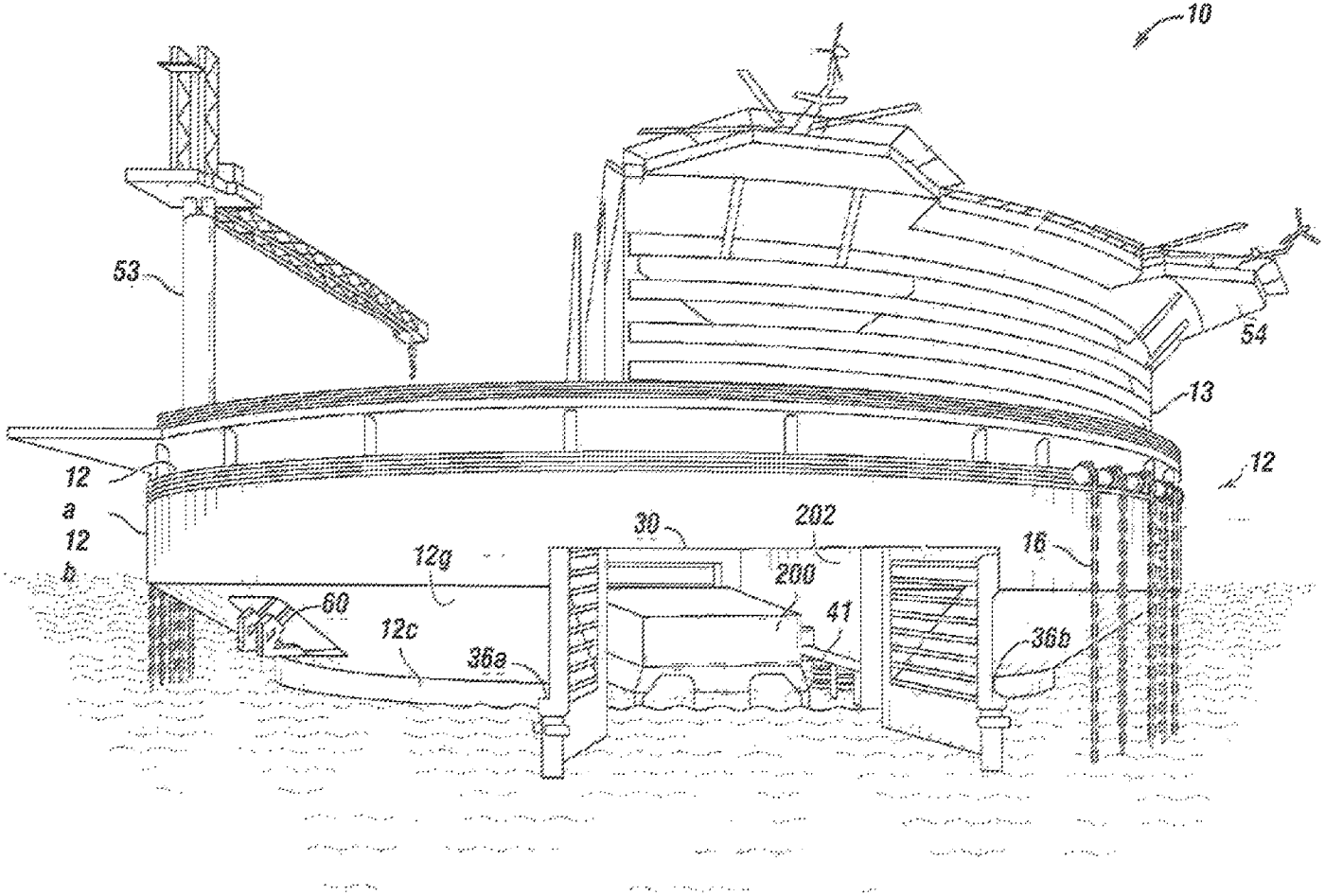
FIG. 3 is an enlarged perspective view of the floating buoyant structure at operational depth.

FIG. 3 shows the buoyant structure 10 with the main deck 12*a* and the superstructure 13 over the main deck.

In embodiments, the crane 53 can be mounted to the superstructure 13, which can include a heliport 54.

In this view, a watercraft 200 is in the tunnel having come into the tunnel through the tunnel opening 30 and is positioned between the tunnel sides, of which tunnel side 202 is labeled. A boat lift 41 is also shown in the tunnel, which can raise the watercraft above the operational depth in the tunnel.

The tunnel opening 30 is shown with two doors, each door having a door fender 36*a* and 36*b* for mitigating damage to a watercraft attempting to enter the tunnel, but not hitting the doors.

The door fenders can allow the watercraft to impact the door fenders safely if the pilot cannot enter the tunnel directly due to at least one of large wave and high current movement from a location exterior of the hull.

The catenary mooring lines 16 are shown coming from the upper cylindrical side section 12*b*.

A berthing facility 60 is shown in the hull 12 in the portion of the inwardly-tapering upper frustoconical side section 12*g*. The inwardly-tapering upper frustoconical side section 12*g* is shown connected to the lower inwardly-tapering frustoconical side section 12*c* and the upper cylindrical side section 12*b*.

Figure 4A:
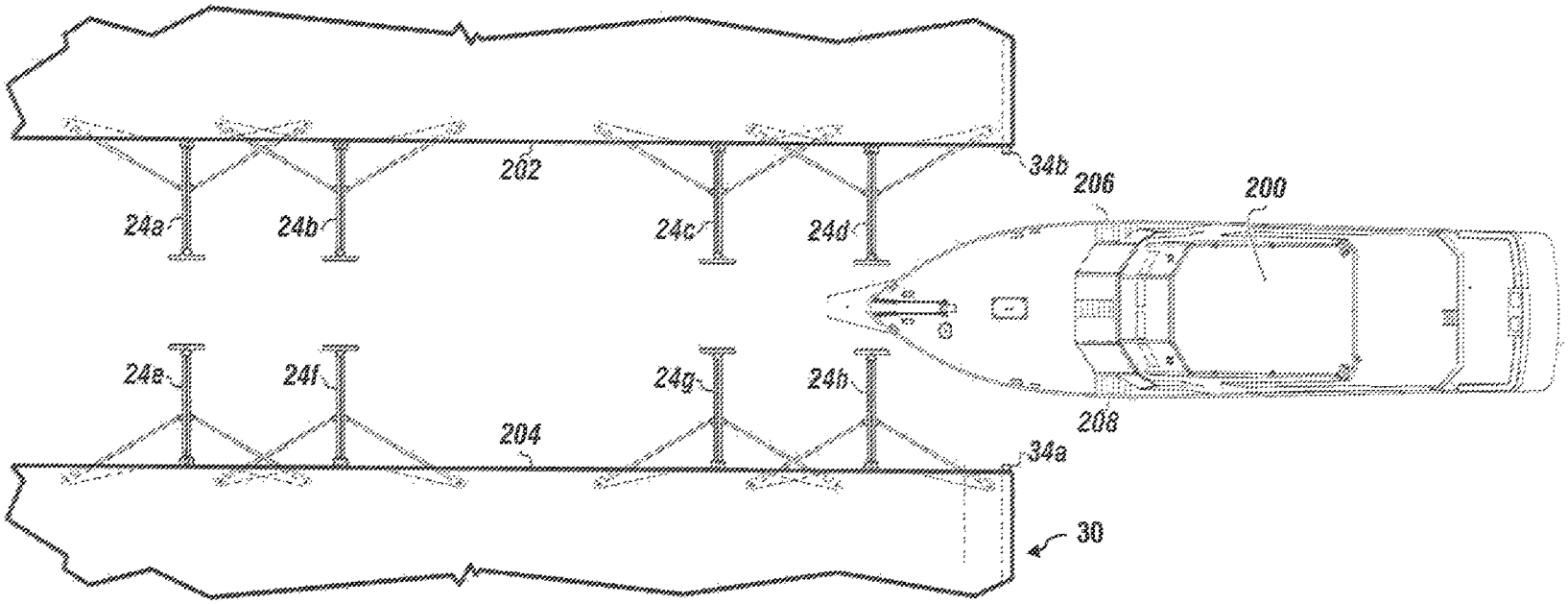
FIG. 4A is a top view of a plurality of dynamic moveable tendering mechanisms in a tunnel before a watercraft has contacted the dynamic moveable tendering mechanisms.

FIG. 4A shows the watercraft 200 entering the tunnel between tunnel sides 202 and 204 and connecting to the plurality of dynamic movable tendering mechanisms 24*a*-24*h*. Proximate to the tunnel opening are closable doors 34*a* and 34*b* which can be sliding pocket doors to provide either a weather tight or water tight protection of the tunnel from the exterior environment. The starboard side 206 hull and port side 208 hull of the watercraft are also shown.

Figure 4B:
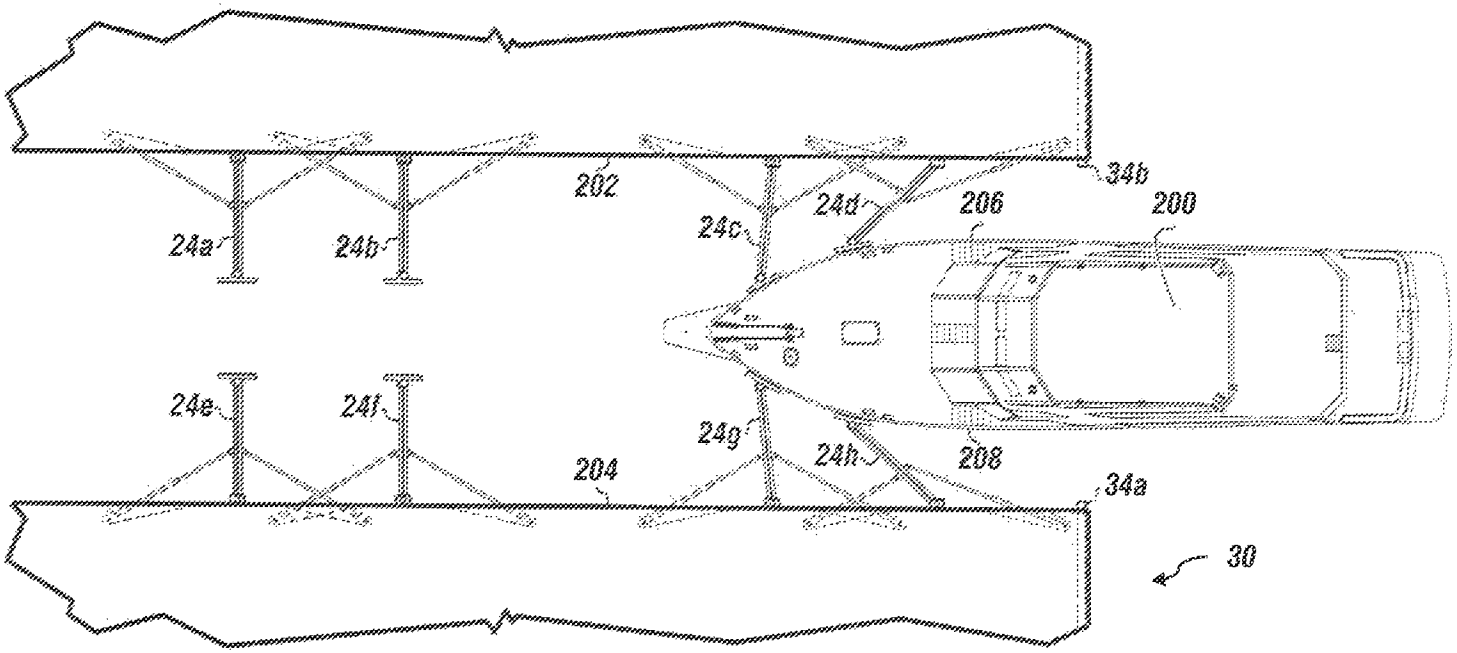
FIG. 4B is a top view of a plurality of dynamic moveable tendering mechanisms in a tunnel as the hull of a watercraft has contacted the dynamic moveable tendering mechanisms.

FIG. 4B shows the watercraft 200 inside a portion of the tunnel between tunnel sides 202 and 204 and connecting to the plurality of dynamic movable tendering mechanisms 24*a*-24*h*. Dynamic moveable tendering mechanisms 24*g* and 24*h* are shown contacting the port side 208 hull of the watercraft 200. Dynamic moveable tendering mechanisms 24*c* and 24*d* are seen contacting the starboard side 206 hull of the watercraft 200. The closable doors 34*a* and 34*b* are also shown.

Figure 4C:
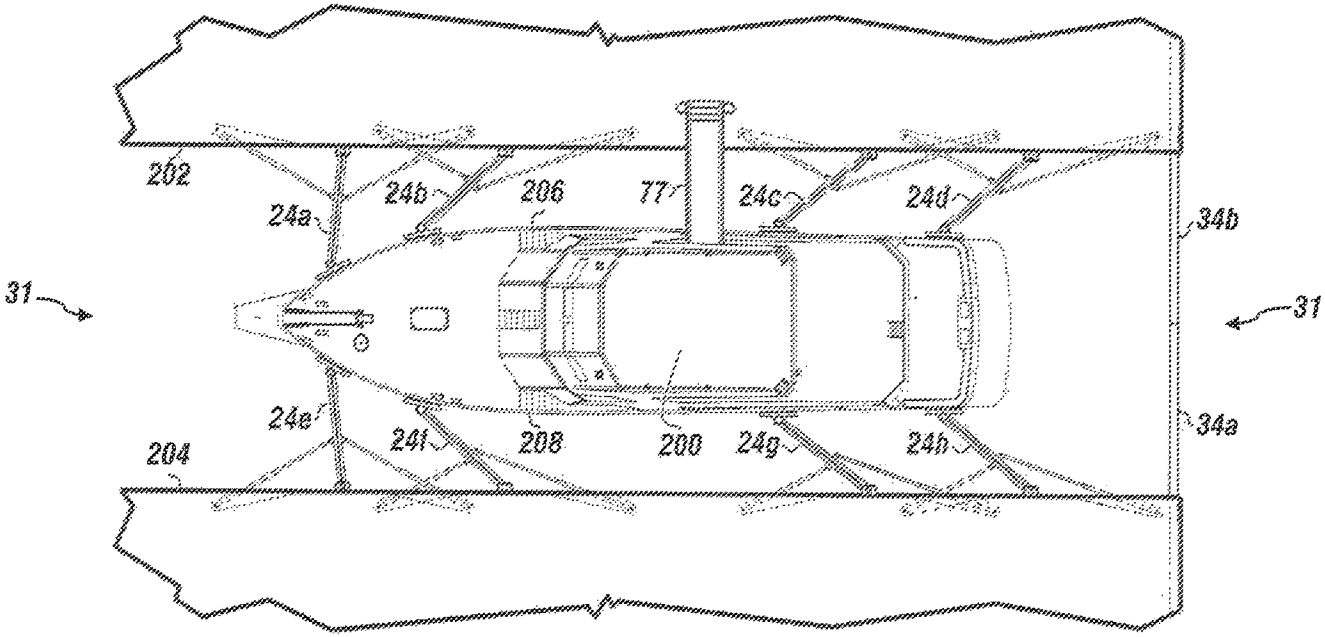
FIG. 4C is a top view of a plurality of dynamic moveable tendering mechanisms in a tunnel connecting to the watercraft with the doors closed.

FIG. 4C shows the watercraft 200 in the tunnel between tunnel sides 202 and 204 and connecting to the plurality of dynamic movable tendering mechanisms 24*a*-24*h* and also connected to a gangway 77. Proximate to the tunnel opening are closable doors 34*a* and 34*b* which can be sliding pocket doors oriented in a closed position providing either a weather tight or water tight protection of the tunnel from the exterior environment. The plurality of the dynamic moveable tendering mechanisms 24*a*-24*h* are shown in contact with the hull of the watercraft on both the starboard side 206 and port side 208.

Figure 5:
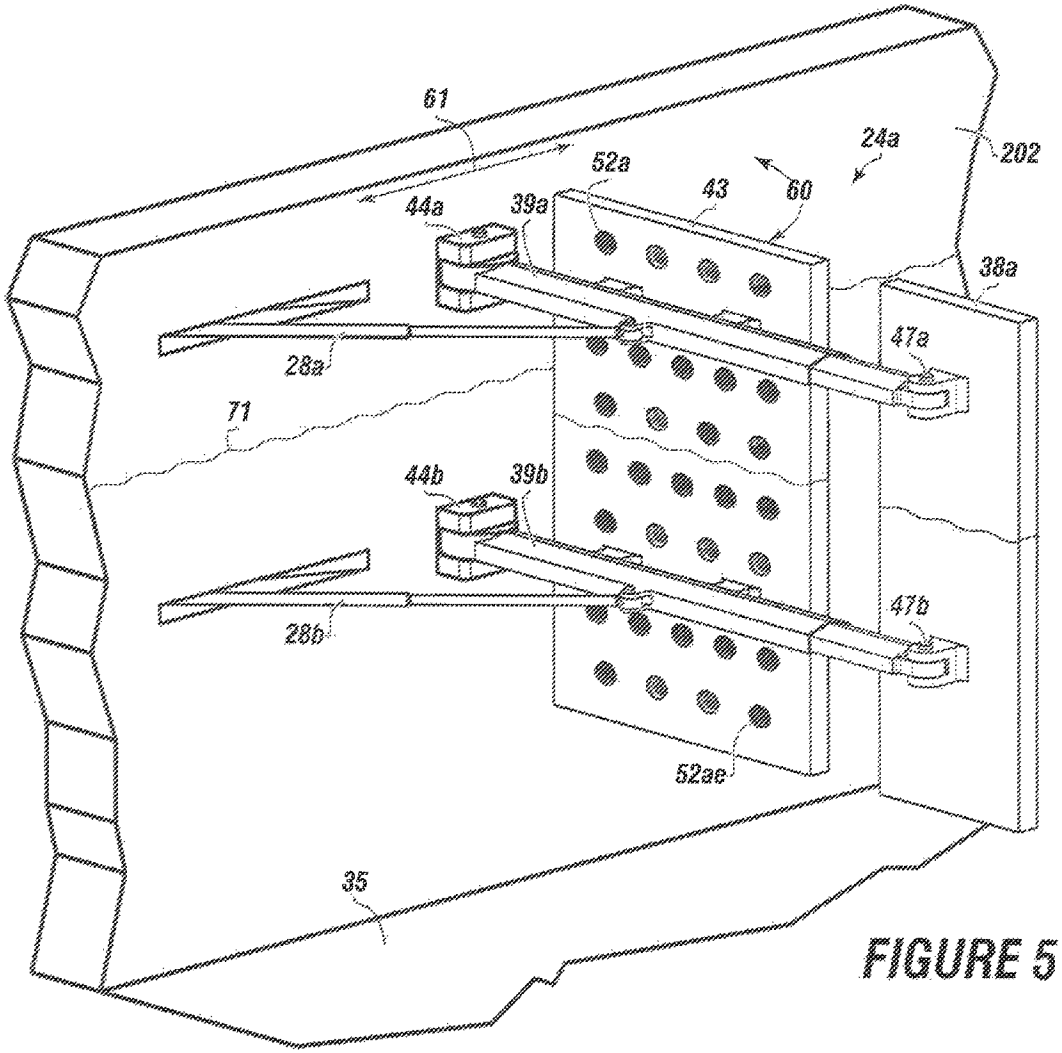
FIG. 5 is an elevated perspective view of one of the dynamic moveable tendering mechanisms.

FIG. 5 shows one of the plurality of the dynamic movable tendering mechanisms 24*a*. Each dynamic movable tendering mechanism can have a pair of parallel arms 39*a* and 39*b* mounted to a tunnel side, shown as tunnel side 202 in this Figure.

A fender 38*a* can connect to the pair of parallel arm 39*a* and 39*b* on the sides of the parallel arms opposite the tunnel side.

A plate 43 can be mounted to the pair of parallel arms 39*a* and 39*b* and between the fender 38*a* and the tunnel side 202.

The plate 43 can be mounted above the tunnel floor 35 and positioned to extend above the operational depth 71 in the tunnel and below the operational depth 71 in the tunnel simultaneously.

The plate 43 can be configured to dampen movement of the watercraft as the watercraft moves from side to side in the tunnel. The plate and entire dynamic movable tendering mechanism can prevent damage to the ship hull, and push a watercraft away from a ship hull without breaking towards the tunnel center. The embodiments can allow a vessel to bounce in the tunnel without damage.

A plurality of pivot anchors 44*a* and 44*b* can connect one of the parallel arms to the tunnel side.

Each pivot anchor can enable the plate to swing from a collapsed orientation against the tunnel sides to an extended orientation at an angle 60, which can be up to 90 degrees from a plane 61 of the wall enabling the plate on the parallel arm and the fender to simultaneously (i) shield the tunnel from waves and water sloshing effects, (ii) absorb kinetic energy of the watercraft as the watercraft moves in the tunnel, and (iii) apply a force to push against the watercraft keeping the watercraft away from the side of the tunnel.

A plurality of fender pivots 47*a* and 47*b* are shown, wherein each pivot can form a connection between each parallel arm and the fender 38*a*, each fender pivot can allow the fender to pivot from one side of the parallel arm to an opposite side of the parallel arm through at least 90 degrees as the watercraft contacts the fender 38*a*.

A plurality of openings 52*a*-52*ae* in the plate 43 can reduce wave action. Each opening can have a diameter from 0.1 meters to 2 meters. In embodiments, the openings 52 can be ellipses.

At least one hydraulic cylinder 28*a* and 28*b* can be connected to each parallel arm for providing resistance to watercraft pressure on the fender and for extending and retracting the plate from the tunnel sides.

Figure 6:
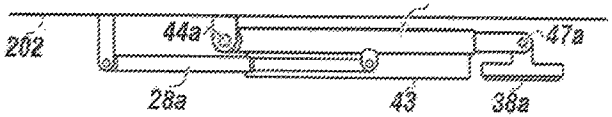
FIG. 6 is a collapsed top view of one of the dynamic moveable tendering mechanisms.

FIG. 6 shows one of the pair of parallel arms 39*a* mounted to a tunnel side 202 in a collapsed position.

The parallel arm. 39*a* can be connected to the pivot anchor 44*a* that engages the tunnel side 202.

Fender pivot 47*a* can be mounted on the parallel arm opposite the pivot anchor 44*a*.

The fender 38*a* can be mounted to the fender pivot 47*a*.

The plate 43 can be attached to the parallel arm 39*a*.

The hydraulic cylinder 28*a* can be attached to the parallel arm and the tunnel wall.

Figure 7:
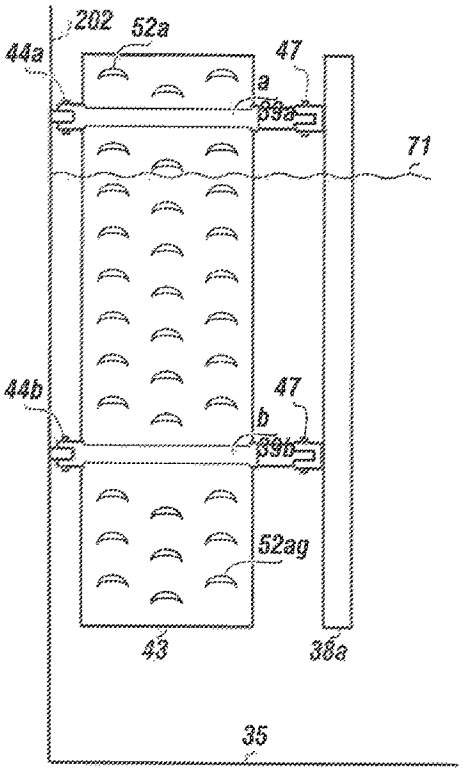
FIG. 7 is a side view of an embodiment of the dynamic moveable tendering mechanism.

FIG. 7 shows the plate 43 with openings 52*a*-52*ag* that can be generally round in shape, wherein the plate is shown mounted above the tunnel floor 35.

The plate can extend both above and below the operational depth 71.

The tunnel side 202, pivot anchors 44*a* and 44*b*, parallel arms 39*a* and 39*b*, fender pivots 47*a* and 47*b*, and fender 38*a* are also shown.

Figure 8:
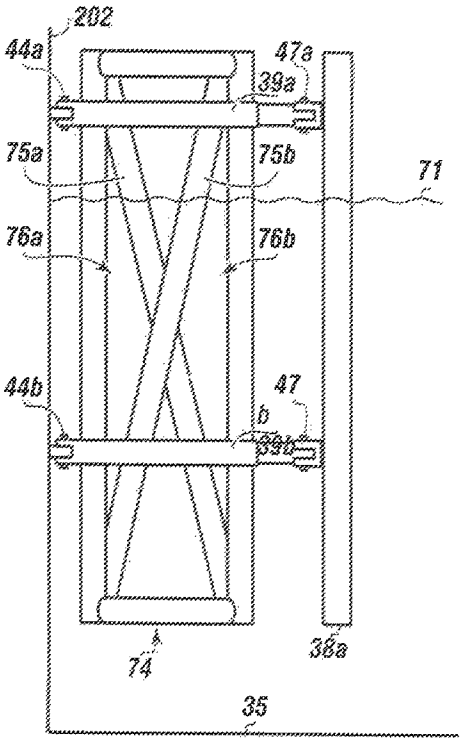
FIG. 8 is a side view of another embodiment of the dynamic moveable tendering mechanism.

FIG. 8 shows an embodiment of a dynamic moveable tendering mechanism formed from a frame 74 instead of the plate. The frame 74 can have intersecting tubulars 75*a* and 75*b* that form openings 76*a* and 76*b* for allowing water to pass while water in the tunnel is at an operational depth 71.

The tunnel side 202, tunnel floor 35, pivot anchors 44*a* and 44*b*, parallel arms 39*a* and 39*b*, fender pivots 47*a* and 47*b*, and fender 38*a* are also shown.

Figure 9:
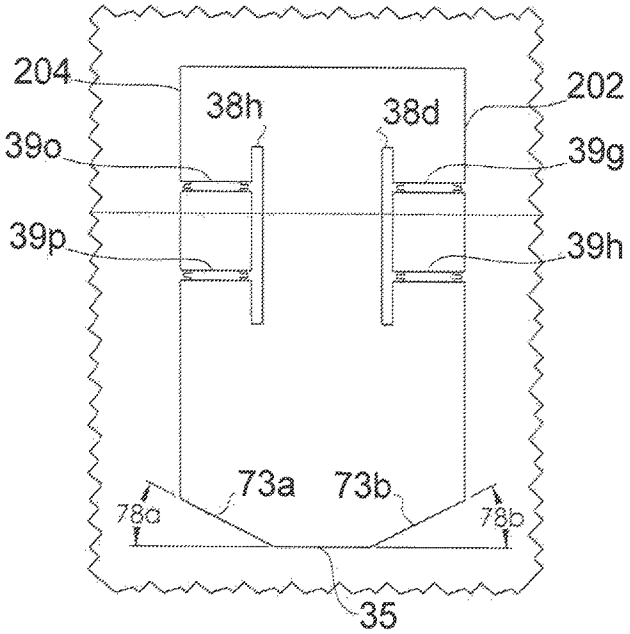
FIG. 9 is a cut away view of the tunnel.

FIG. 9 shows the tunnel floor 35 having lower tapering surfaces 73*a* and 73*b* at an entrance of the tunnel, providing a "beach effect" that absorbs surface wave energy effect inside of the tunnel. The lower tapering surfaces can be at an angle 78*a* and 78*b* that is from 3 degrees to 40 degrees.

Two fenders 38*h* and 38*d* can be mounted between two pairs of parallel arms. Fender 38*h* can be mounted between parallel arms 39*o* and 39*p*, and fender 38*d* can be mounted between parallel arms 39*g* and 39*h*.

In embodiments, the pair of parallel arms can be simultaneously extendable and retractable.

The tunnel walls 202 and 204 are also shown.

Figure 10A:
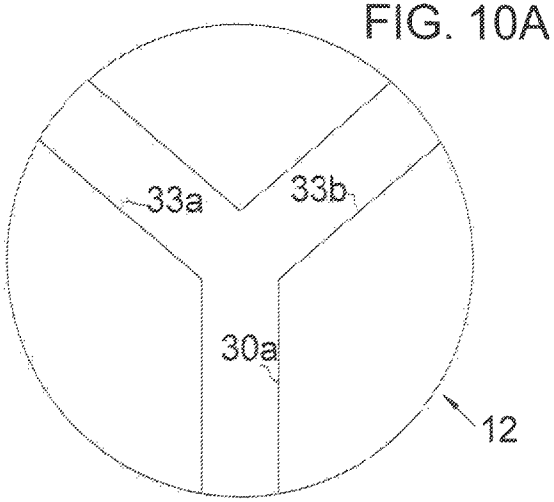
FIGS. 10A and 10B is a top view of a Y-shaped tunnel in the hull of the buoyant structure.

FIG. 10A shows a Y-shaped configuration from a top cutaway view of the hull 12 with the tunnel 30 with the tunnel openings, in communication with a branch 33*a* and branch 33*b* going to additional openings 32*a* and 32*b* respectively.

Figure 10B:
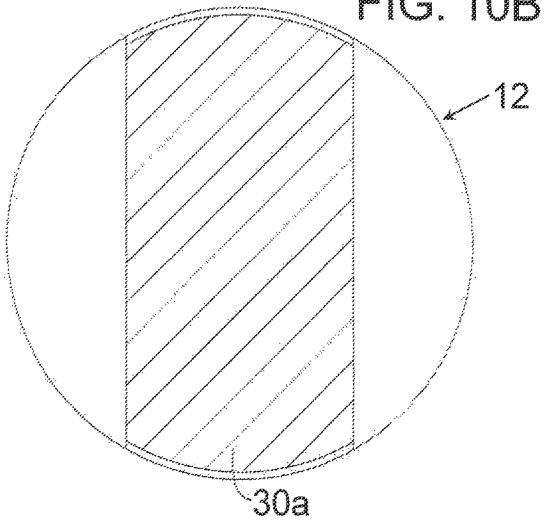

FIG. 10B shows a one-way tunnel 30 without the Y-shaped configuration. The tunnel has an opening 30 that goes through the hull 12.

The buoyant structure can have a transit depth and an operational depth, wherein the operational depth is achieved using ballast pumps and filling ballast tanks in the hull with water after moving the structure at transit depth to an operational location.

The transit depth can be from about 7 meters to about 15 meters, and the operational depth can be from about 45 meters to about 65 meters. The tunnel can be out of water during transit.

Straight, curved, or tapering sections in the hull can form the tunnel.

In embodiments, the plates, closable doors, and hull can be made from steel.

Figure 11:
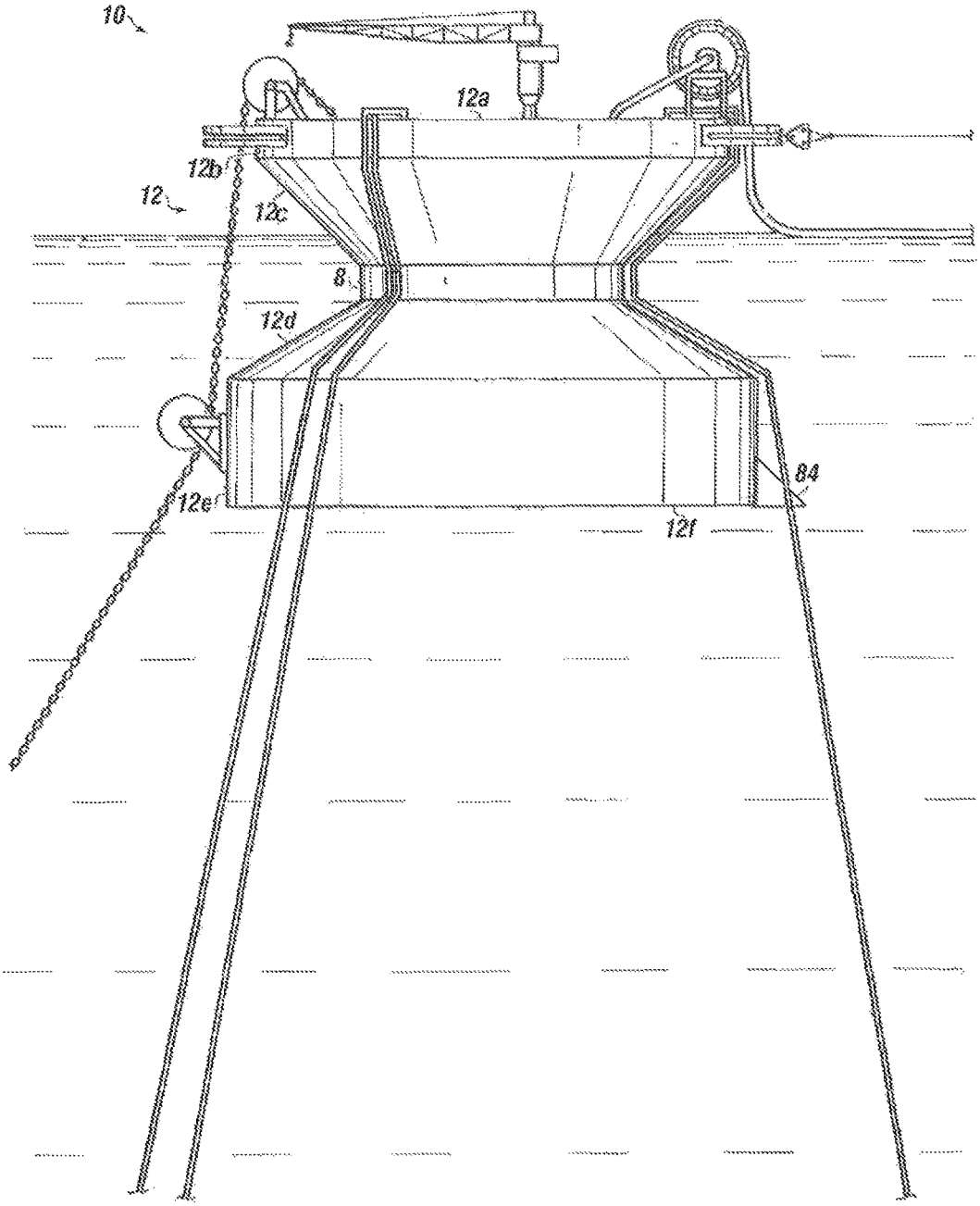
FIG. 11 is a side view of the buoyant structure with a cylindrical neck.

FIG. 11 is a side view of the buoyant structure with a cylindrical neck.

The buoyant structure 10 is shown having a hull 12 with a main deck 12*a*.

The buoyant structure 10 has an upper cylindrical side section 12*b* extending downwardly from the main deck 12*a* and a lower inwardly tapering frustroconical side section 12*c* extending from the upper cylindrical side section 12*b*.

The buoyant structure 10 has a cylindrical neck 8 connecting to the lower inwardly tapering frustroconical side section 12*c*.

A lower frustoconical side section 12*d* extends from the cylindrical neck 8.

A lower generally round section. 12*e* connects to the lower frustoconical side section 12*d*.

A keel having an n-polytope shape 12*f* is formed at the bottom of the lower generally round section 12*e*.

A fin-shaped appendage 84 is secured to a lower and an outer portion of the exterior of the keel having an n-polytope shape 12*f*.

Figure 12:
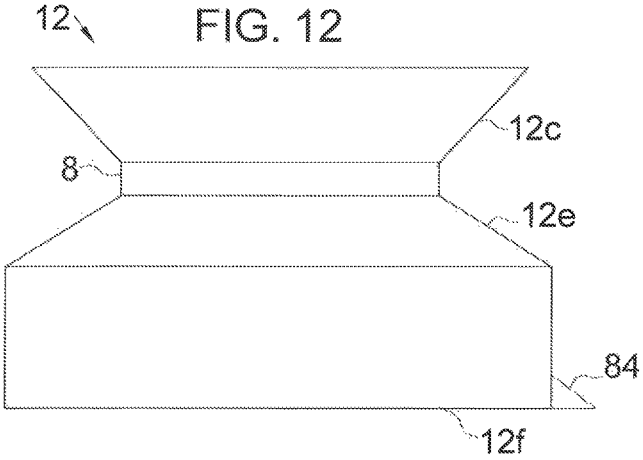
FIG. 12 is detailed view of another embodiment of the buoyant structure with a cylindrical neck in a transport configuration.

FIG. 12 is detailed view of the buoyant structure having a hull 12 with a cylindrical neck 8.

A lower inwardly-tapering frustoconical side section 12*c* extends from a main deck 12*a* to the cylindrical neck 8.

A lower generally round section 12*e* extends from the cylindrical neck opposite the lower inwardly-tapering frustroconical side section 12*c*.

A keel having an n-polytope shape 12*f* is at the bottom of the lower generally round section 12*e*.

A fin-shaped appendage 84 is shown secured to a lower and an outer portion of the exterior of the keel having an n-polytope shape and extends from the keel having an n-polytope shape into the water.

Figure 13A:
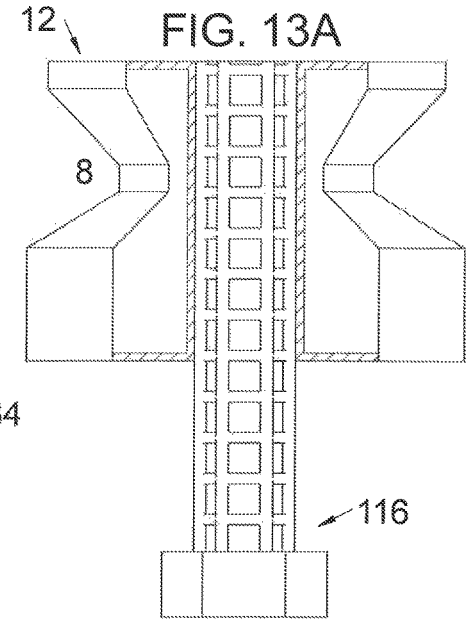
FIG. 13A is a cut away view of another embodiment of the buoyant structure with a cylindrical neck in a transport configuration with a central pendulum.

FIG. 13A is a cut away view of the buoyant structure having a hull 12 with a cylindrical neck 8 and a raised center pendulum 116 in a transport configuration.

In embodiments, the buoyant structure 10 can have a pendulum 116, which can be moveable. In embodiments, the pendulum is optional and can be partly incorporated into the hull to provide optional adjustments to the overall hull performance.

In this Figure, the pendulum 116 is shown at a transport depth.

In embodiments, the moveable pendulum can be configured to move between a transport depth and an operational depth and the pendulum can be configured to dampen movement of the watercraft as the watercraft moves from side to side in the water.

Figure 13B:
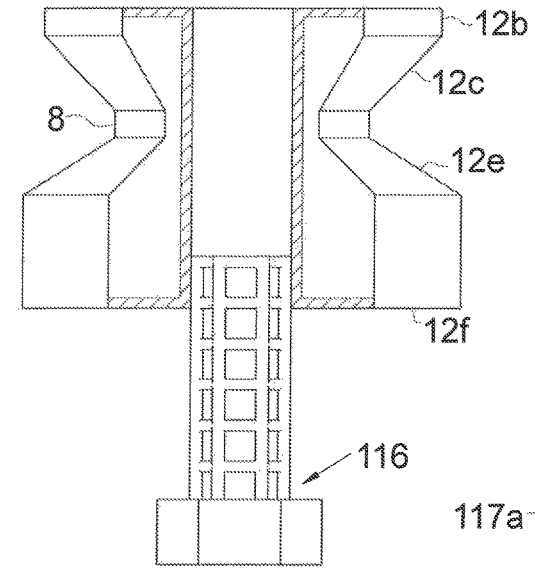
FIG. 13B is a cut away view of the buoyant structure with a cylindrical neck in an operational configuration.

FIG. 13B is a cut away view of the buoyant structure 10 with a cylindrical neck 8 in an operational configuration.

Figure 14:
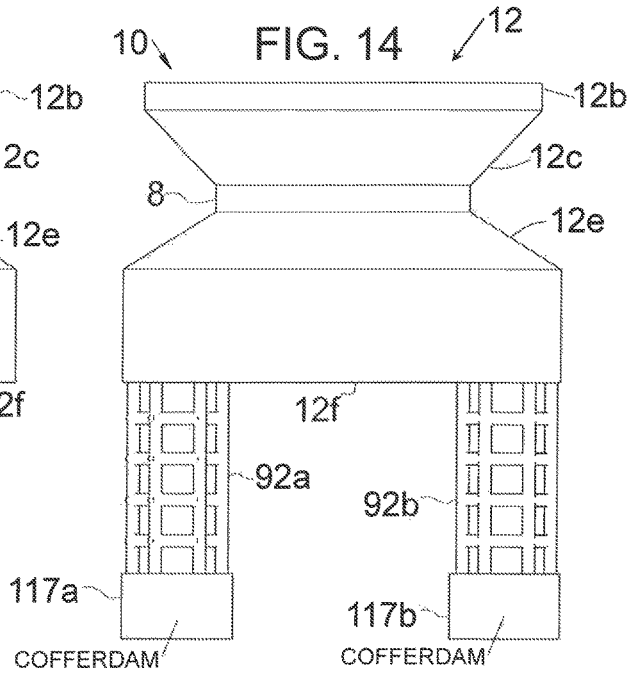
FIG. 14 is a side view of the buoyant structure with a cylindrical neck and two sets of parallel frames extending from the keel each set of parallel frames having a keel extension. The sets of parallel frames mounted in parallel with each other and connected to the generally rounded keel.

FIG. 14 is a side view of the buoyant structure 10 with a cylindrical neck 8 and two sets of parallel frames 92*a*-92*d* and 92*e*-92*h*. Each set of parallel frames can extend from the keel having an n-polytope shape 12*f*.

A keel extension 117*a* can be attached to the set of parallel frames.

The buoyant structure 10 is shown with a lower inwardly-tapering frustoconical side section 12*e* extending to the cylindrical neck 8.

A lower, generally round section 12*e* extends from the cylindrical neck 8 opposite the lower inwardly-tapering frustroconical side section 12*c*.

A keel having an n-polytope shape 12*f* is at the bottom of the lower generally round section 12*e*.

An upper cylindrical side section 12*b* is also depicted.

Each set of parallel frames is mounted in parallel with each other and connected to the keel.

Figure 15A:
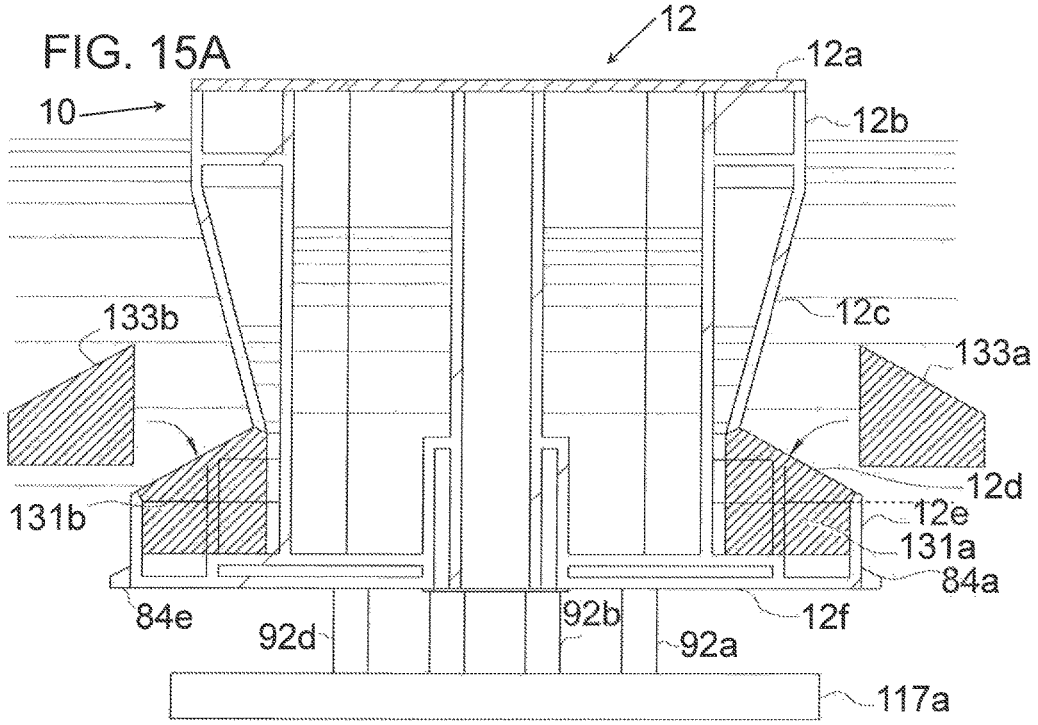
FIG. 15A depicts a section view of the buoyant structure according to one or more embodiments.
Figure 15B:
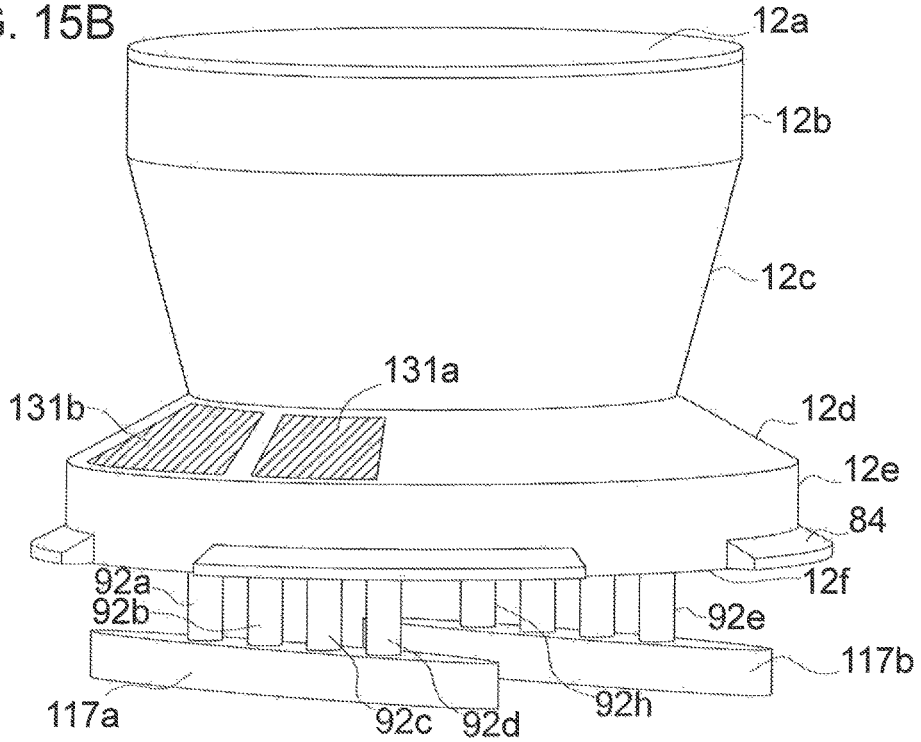
FIG. 15B depicts an isometric view of the buoyant structure according to one or more embodiments.

FIGS. 15A and 15B depict a section view of a buoyant structure according to one or more embodiments.

The buoyant structure 10 with a bull 12 can have a main deck 12*a*.

In embodiments, the hull 12 can be ballasted to move between a transport depth and an operational depth.

Fin shaped appendages 84*a*-84*e* are configured to dampen movement of the buoyant structure as the buoyant structure moves from side to side in water.

A lower inwardly-tapering frustoconical side section 12*c* can extend from the main deck 12*a*.

An upper cylindrical side section 12*b* is shown between the main deck 12*a* and the lower inwardly tapering frustroconical side section 12*c*.

A lower generally round section 12*e* can extend from the lower inwardly-tapering frustroconical side section 12*c*.

In embodiments, each lower generally rounded section 12*e* can have a plurality of openings 131*a*-131*b* for receiving inserts 133*a*-133*b* for ballasting.

In embodiments, the buoyant structure 10 can have a keel having an n-polytope shape 12*f*.

A fin-shaped appendage 84*a* can be secured to a lower and an outer portion of the exterior of the keel 12*f* having an n-polytope shape.

A plurality of parallel frame 92*a*-92*d* can extend from the keel having an n-polytope shape 12*f* and support a keel extension 117*a* which can be a pontoon.

The keel extension 117 can be connected to the parallel frames 92*a*-92*d*.

The keel extension can be a pair of pontoons mounted in parallel separated by the parallel frames or a pair of pontoons mounted with the parallel frames mounted apart and in parallel to each other. The keel extension can be a pontoon containing a portion of a group of the parallel frames.

Figure 16:
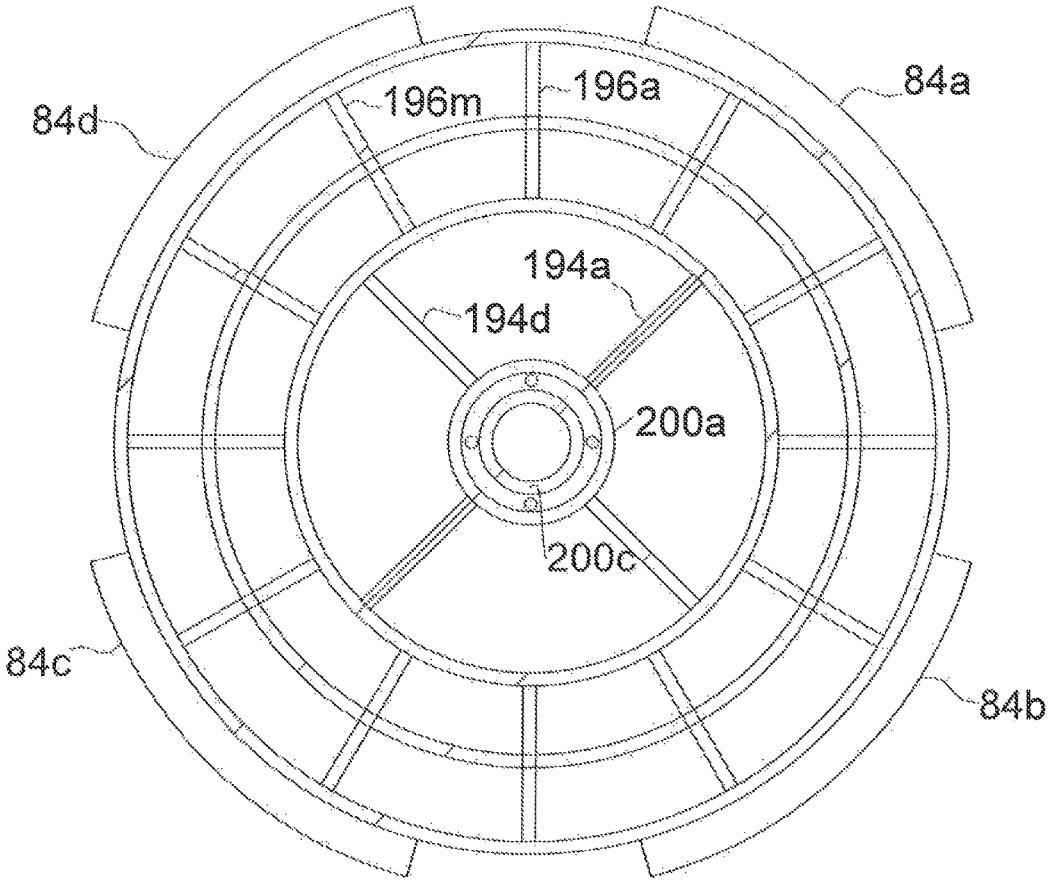
FIG. 16 depicts a cross section of the buoyant structure according to one or more embodiments with a fin configuration for damping.

FIG. 16 depicts a cross section of the vessel according to one or more embodiments with a fin configuration for dampening.

The fin-shaped appendage 84*a*-84*d* are shown in this bottom view of the buoyant structure.

The plurality of parallel frames can be concentric in this embodiment and include support structures 196*a*-196*m* as well as cross members 194*a*-19*d* with additional concentric supports 200*a*-200*c*.

FIGS. 17A-17G depict various embodiments of the keel extension. The different embodiments are shown as keel extensions 117*a*-117*g*.

Some of the keel extensions are depicted with an angular face in accordance with one or more embodiments.

The keel extensions in the embodiments are connected to one or more of the plurality of parallel frames.

Figure 17A:
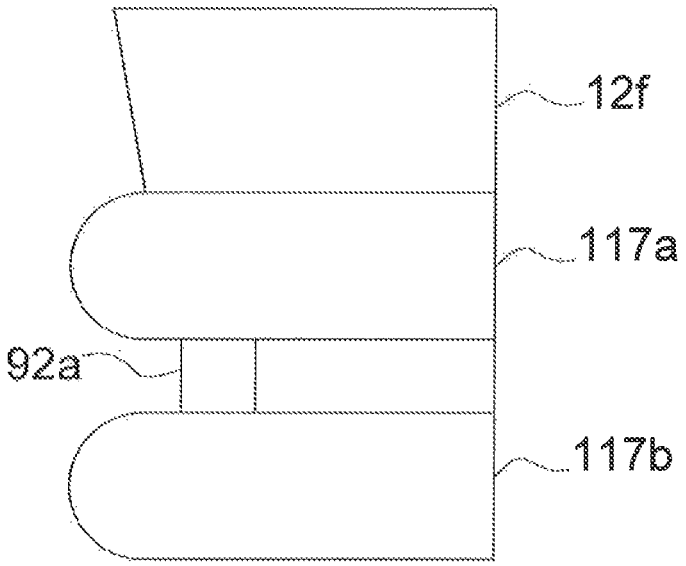

FIG. 17A depicts a first keel extension mounted directly to the keel having an n-polytope shape 12*f* and mounted in parallel with the keel having an n-polytope shape 12*f*. At least one parallel frame 92*a* extends from the first keel extension 117*a* and engages a second keel extension 117*b* mounted in parallel to the first keel extension.

Figure 17B:
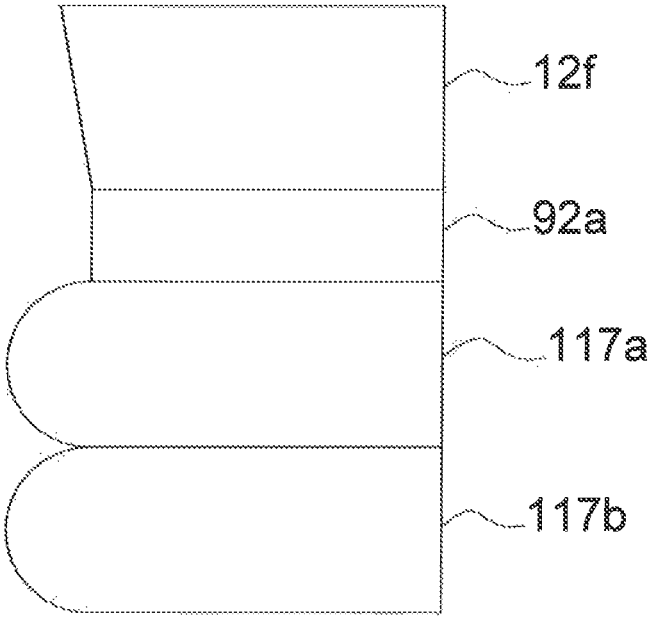

FIG. 17B illustrates a first keel extension 117*a* mounted directly to the keel having an n-polytope shape 12*f* and mounted in parallel with the keel having an n-polytope shape 12*f*. A second keel extension 117*b* is mounted in parallel to the first keel extension and directly engages the first keel extension. Both keel extensions have rounded ends, like a pontoon. The keel extension 117 can be connected to the parallel frame 92*a*.

Figure 17C:
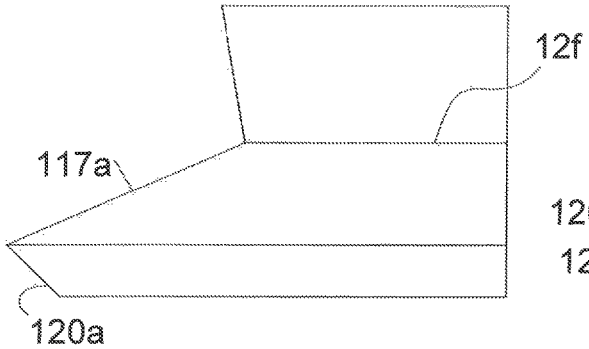

FIG. 17C depicts a first keel extension 117*a* mounted directly to the keel having an n-polytope shape 12*f* and mounted in parallel with the keel having an n-polytope shape 12*f* having an angular face 120*a*.

Figure 17D:
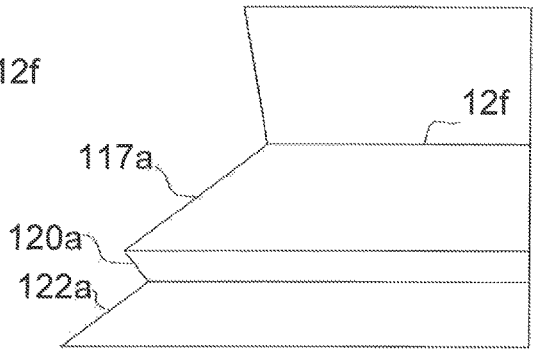

FIG. 17D depicts a first keel extension 117*d* mounted directly to the keel having an n-polytope shape 12*f* and mounted in parallel with the keel having an n-polytope shape 12*f* having an angular face 120*a*, and a second angular face 122*a*.

Figure 17E:
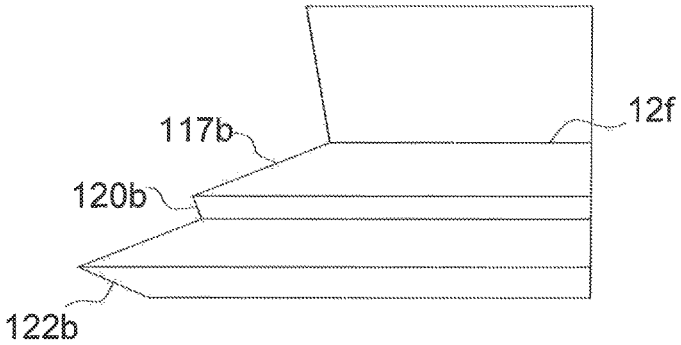

FIG. 17E depicts a first keel extension 117*b* mounted directly to the keel having an n-polytope shape 12*f* and mounted in parallel with the keel having an n-polytope shape 12*f* having an angular face 120*b*, and a second angular face 122*b* in a stepped and separated configuration.

Figure 18A:
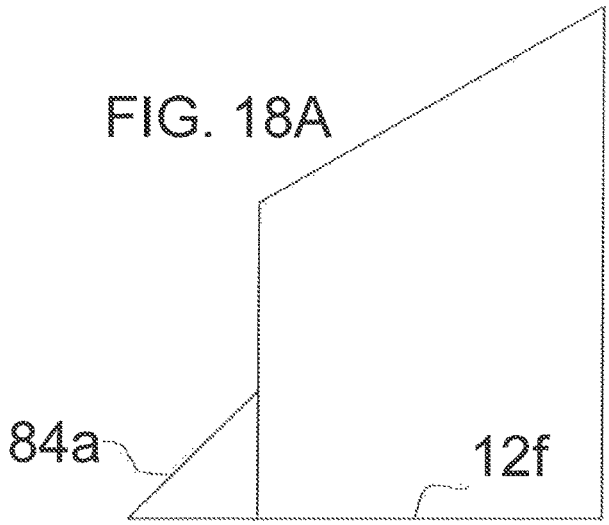
FIGS. 18A-18C depict different embodiments of the fins as a pair of humps and one or two triangular projections.
Figure 18B:
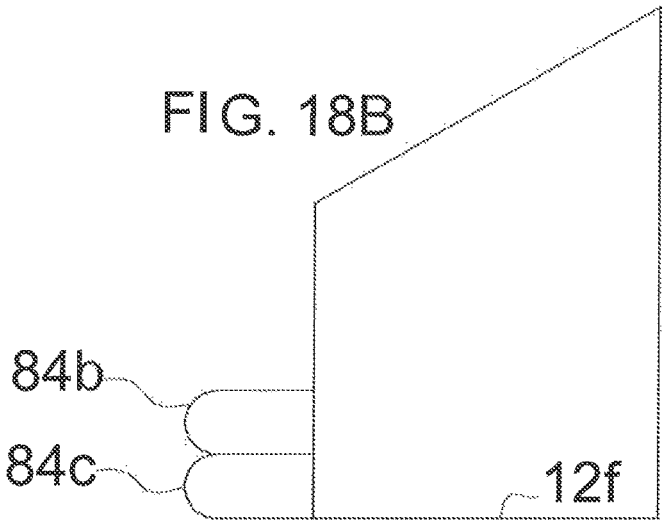
Figure 18C:
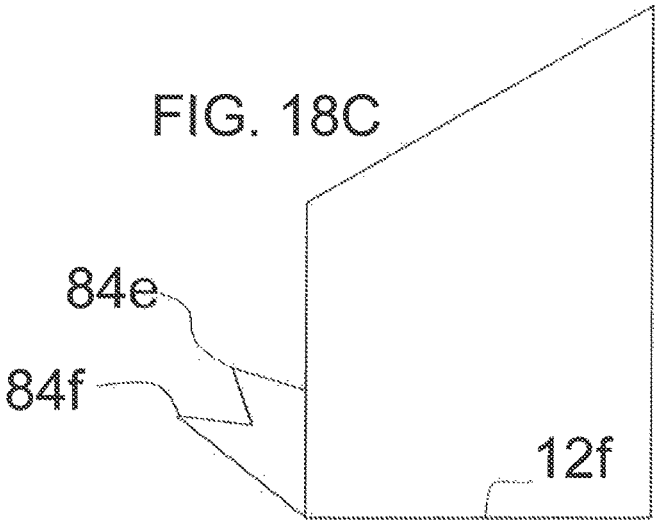
Figure 19A:
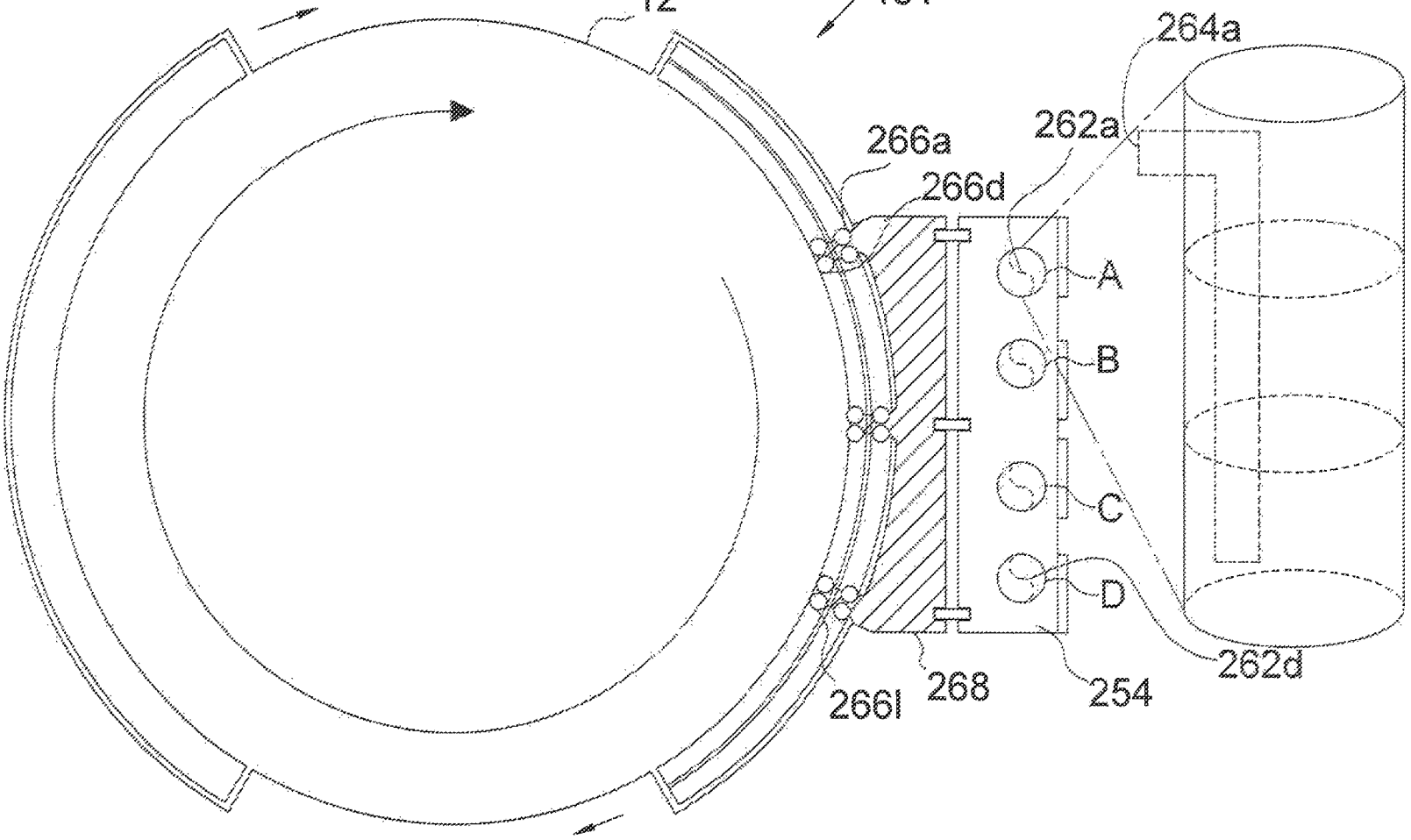
FIG. 19A-19D depict the offloading device according to one or more embodiments.
Figure 19B:
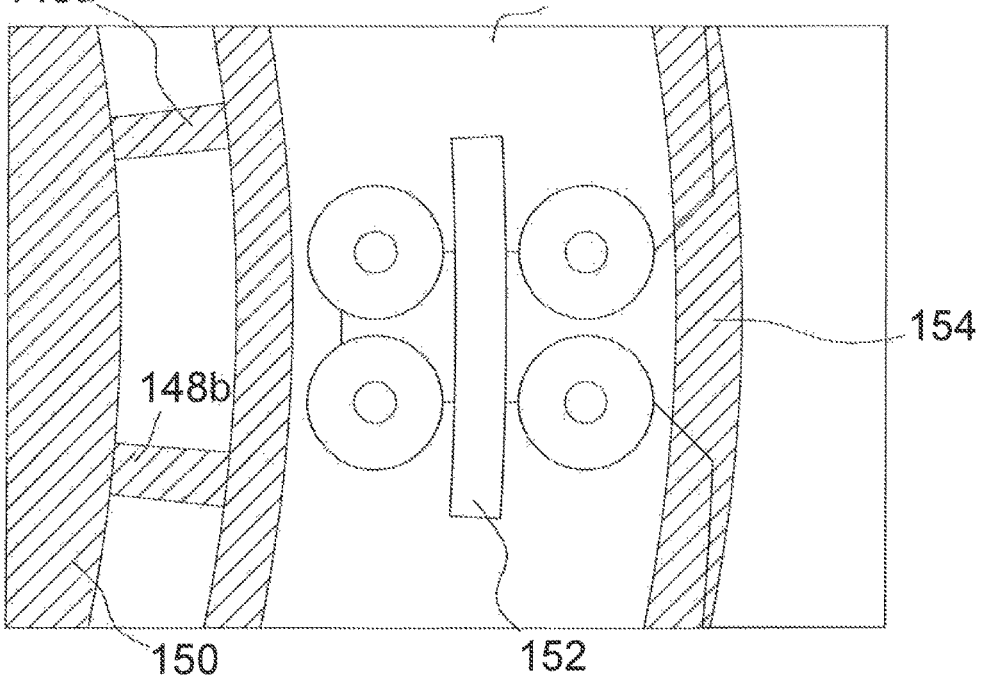
Figure 19C:
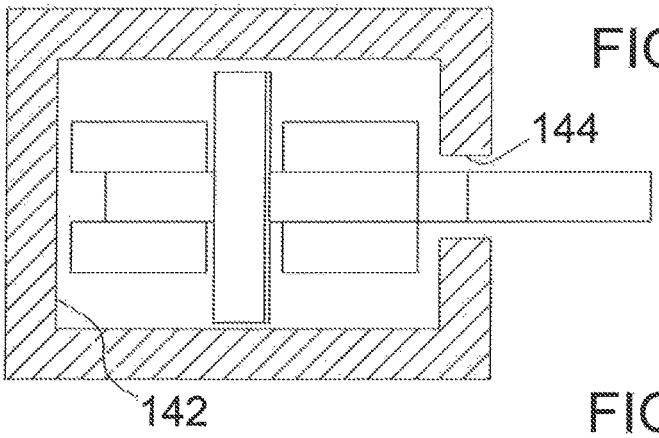
Figure 19D:
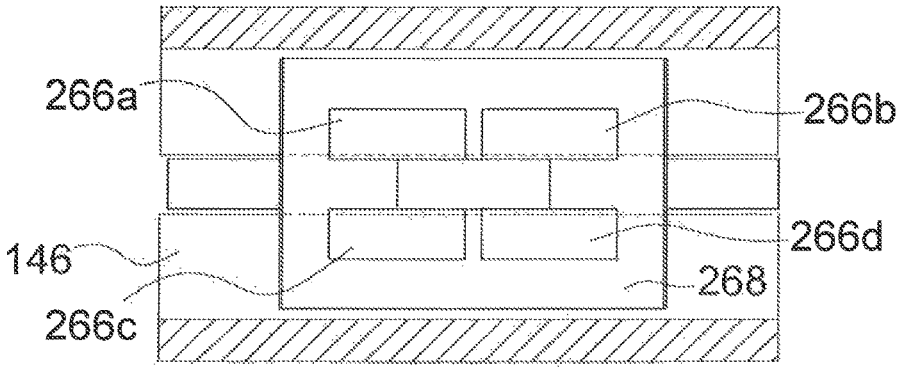

FIGS. 18A-18C depict the fin shaped appendage 84 according to one or more embodiments.

A triangular fin-shaped appendage 84*a* can be secured to a lower and an outer portion of the exterior of the keel having an n-polytope shape 1*i*2*f* as shown in FIG. 18A.

The fin shaped appendage can be a pair of humps 84*b* and 84*c* as shown in FIG. 18B.

The fin shaped appendage can be a pair of triangular projections 84*e* and 84*f* as shown in FIG. 18C.

FIGS. 19A-19D depict the offloading device according to one or more embodiments.

The offloading device 181 is slidably connected to an outside surface of the hull 12.

The offloading device 181 has a nearly fully enclosed tubular channel 142 with a rectangular cross-section and a longitudinal slot 144 on a side wall 146 of the tubular channel, a set of standoffs 148*a*-148*b* that connect the tubular channel 142 horizontally to an outside wall 150 of the hull 12, and a trolley 152 captured and moveable within the tubular channel 142, a trolley connector 154 attached to the trolley 152 providing a connection point to a platform 254 containing ballast chambers 262*a*-262*d*.

A plurality of ballast inlets and outlets 264*a*-264*d* are formed in the nearly fully enclosed tubular channel.

In embodiments, the trolley 152 has a plurality of wheels 266*a*-266*d* mounted on ends of a base plate 268.

Figure 20A:
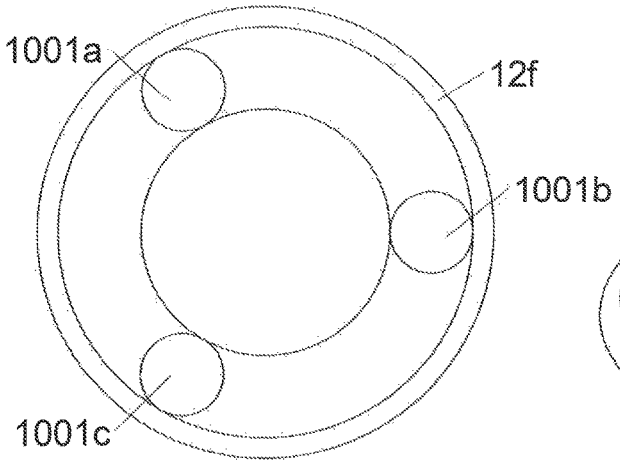
FIGS. 20A-20D depict different embodiments of the columns usable in an embodiment.
Figure 20B:
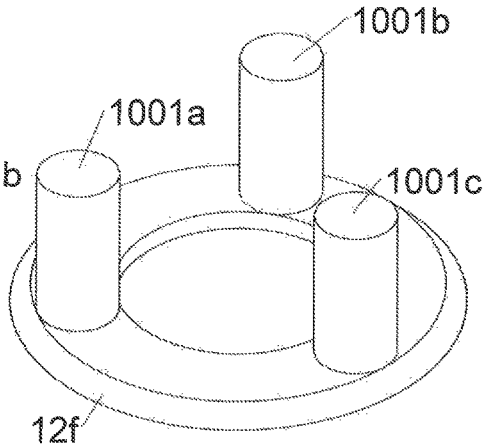

FIGS. 20A-20D depict different embodiments of columns extending form the keel having an n-polytope shape 12*f*. Columns 1001*a*-1001*c* are depicted as cylindrical. FIGS. 20A-20B depict different embodiments of the columns 1001*a*-1001*c*.

The columns extend from the keel having an n-polytope shape 12*f*.

A group of the columns 1001*a*-1001*c* are depicted as cylindrical.

In embodiments the group of columns can have equal heights.

Figure 20C:
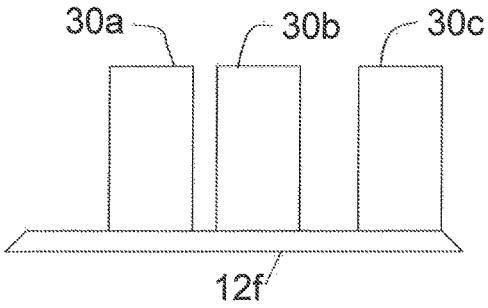
Figure 20D:
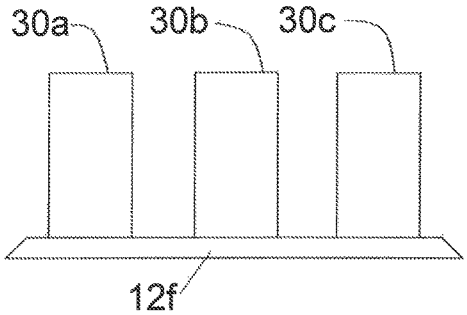

In FIG. 20C-20D, tunnels 30*a*-30*c* are shown formed between the columns.

FIG. 20C shows the tunnels are asymmetrically formed on the keel having an n-polytope shape 12*f*.

FIG. 20D shows the tunnels are symmetrically formed on the keel having an n-polytope shape 2*f*.

Figure 21A:
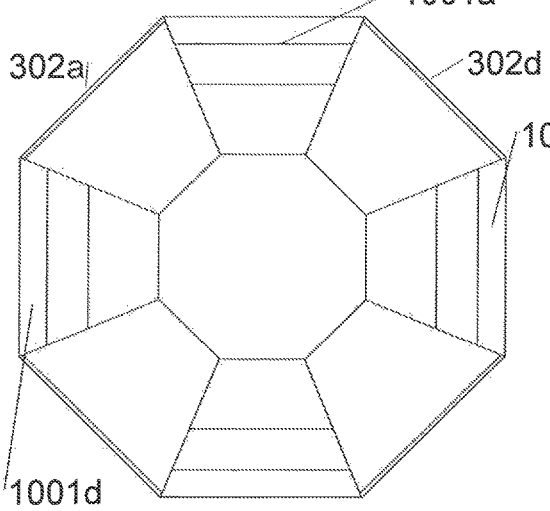
FIGS. 21A-21B depict different column embodiments.
Figure 21B:
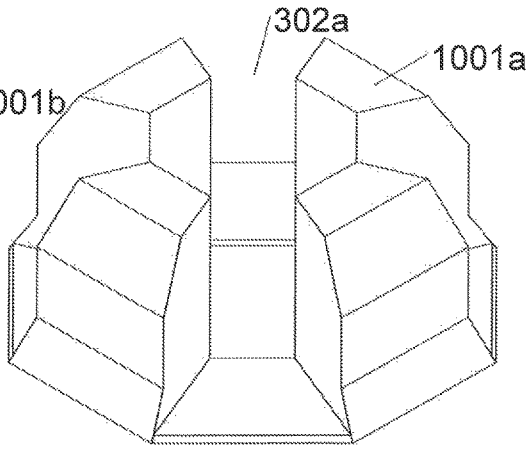
Figure 21C:
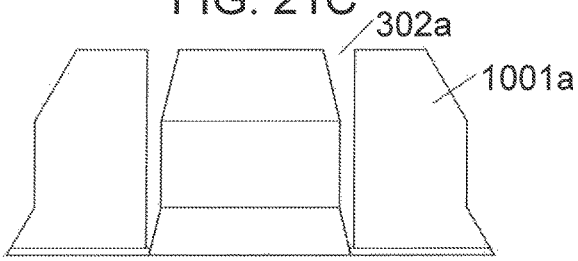
Figure 21D:
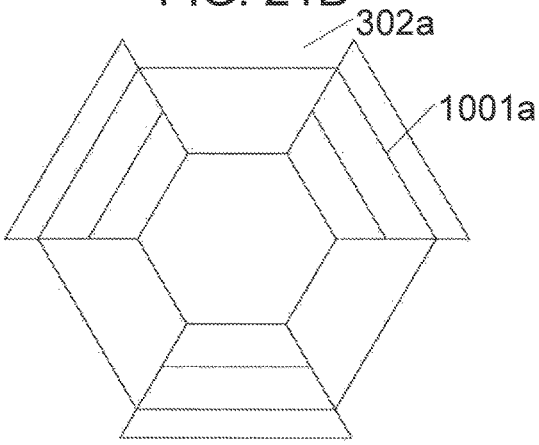
Figure 21E:
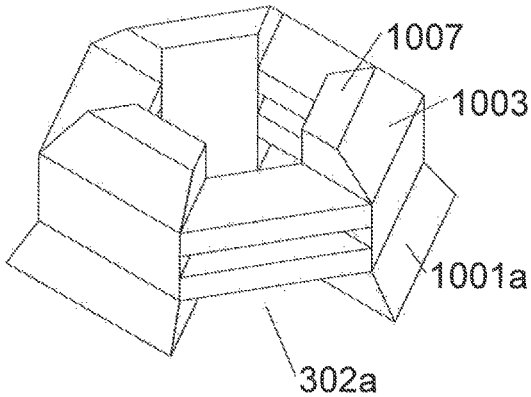
Figure 21F:
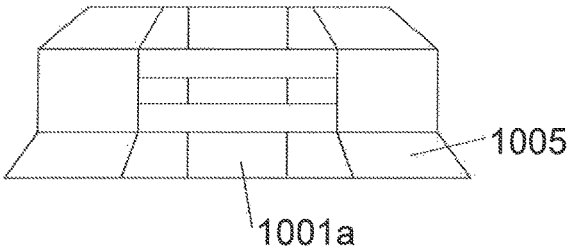
Figure 21G:
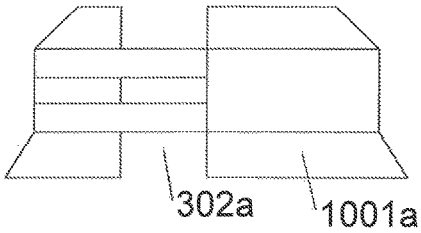
Figure 21H:
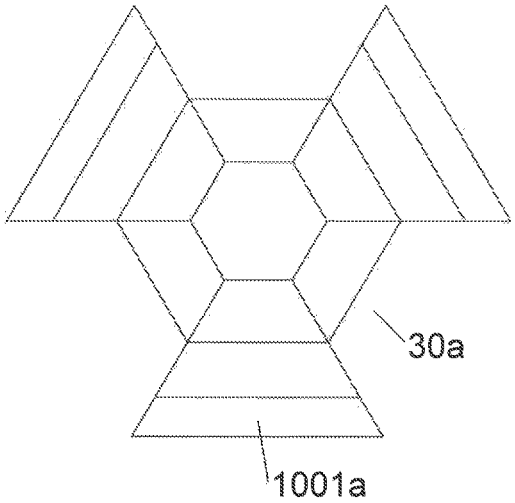
Figure 21I:
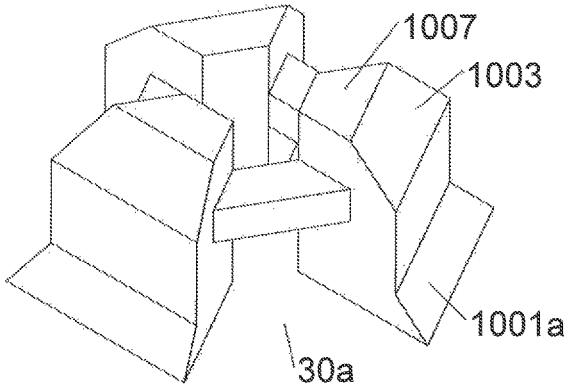
Figure 21J:
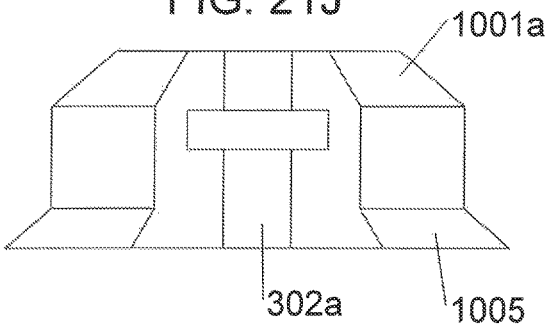
Figure 21K:
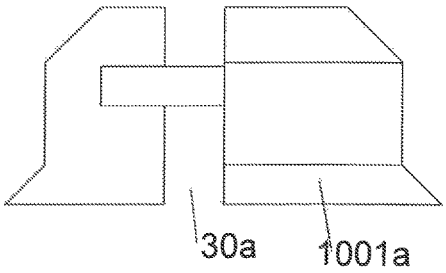
Figure 21L:
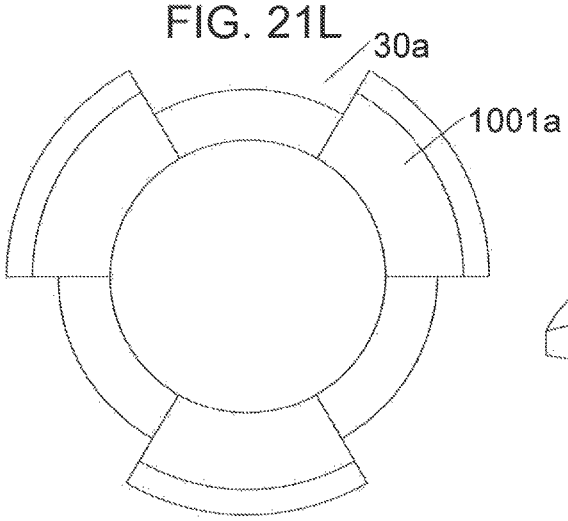
Figure 21M:
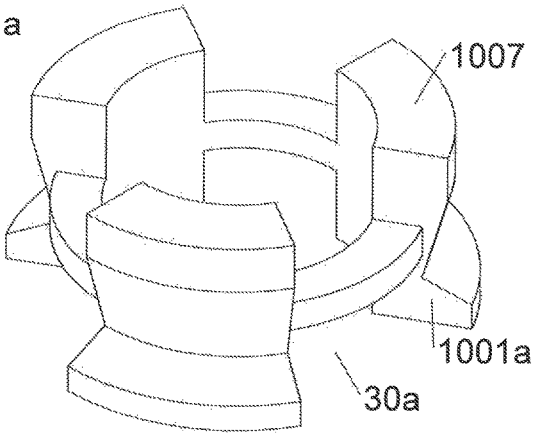
Figure 21N:
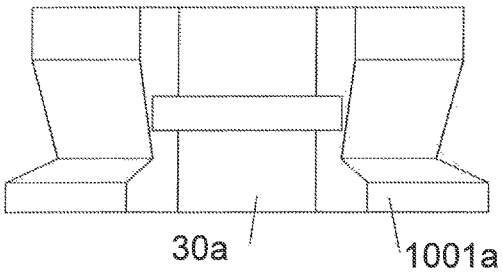
Figure 21O:
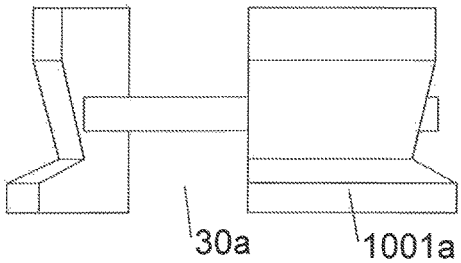

FIGS. 21A-21O show each column having a combination of inward frustroconical flat panels 1003*a*-1003*c* and outward frustroconical flat panels 1005.

In embodiments, each column can have an outer wall 1007 with a shape that is generally round.

FIGS. 21C-21O depict different tunnel configurations and different column shapes, including different sizes and orientations. Some are asymmetrical. Some are symmetrical. Interconnections are shown between the columns to improve structural integrity of the buoyant structure.

Figure 22A:
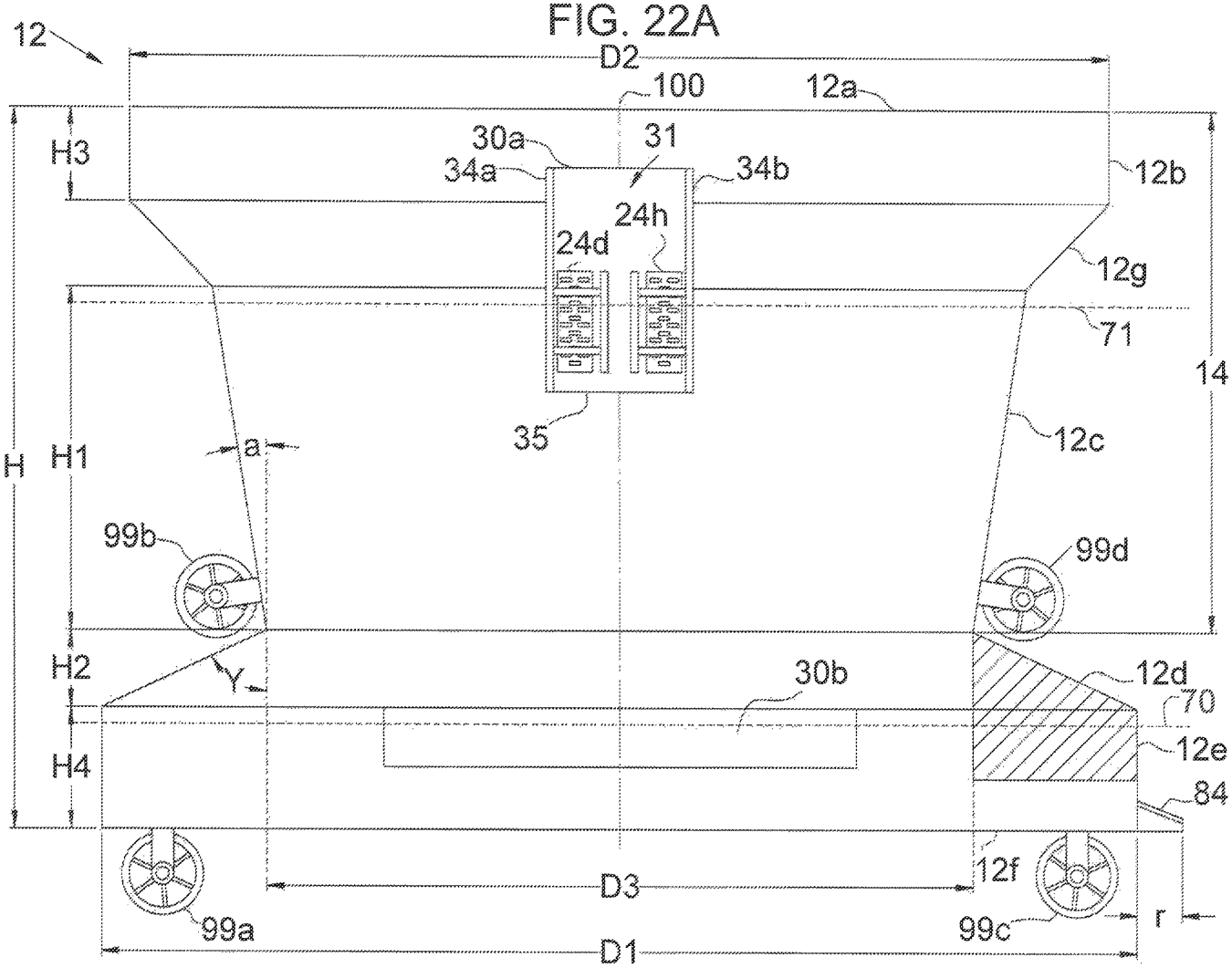
FIGS. 22A-22B depict a buoyant structure with multiple tunnels according to embodiments.
Figure 22B:
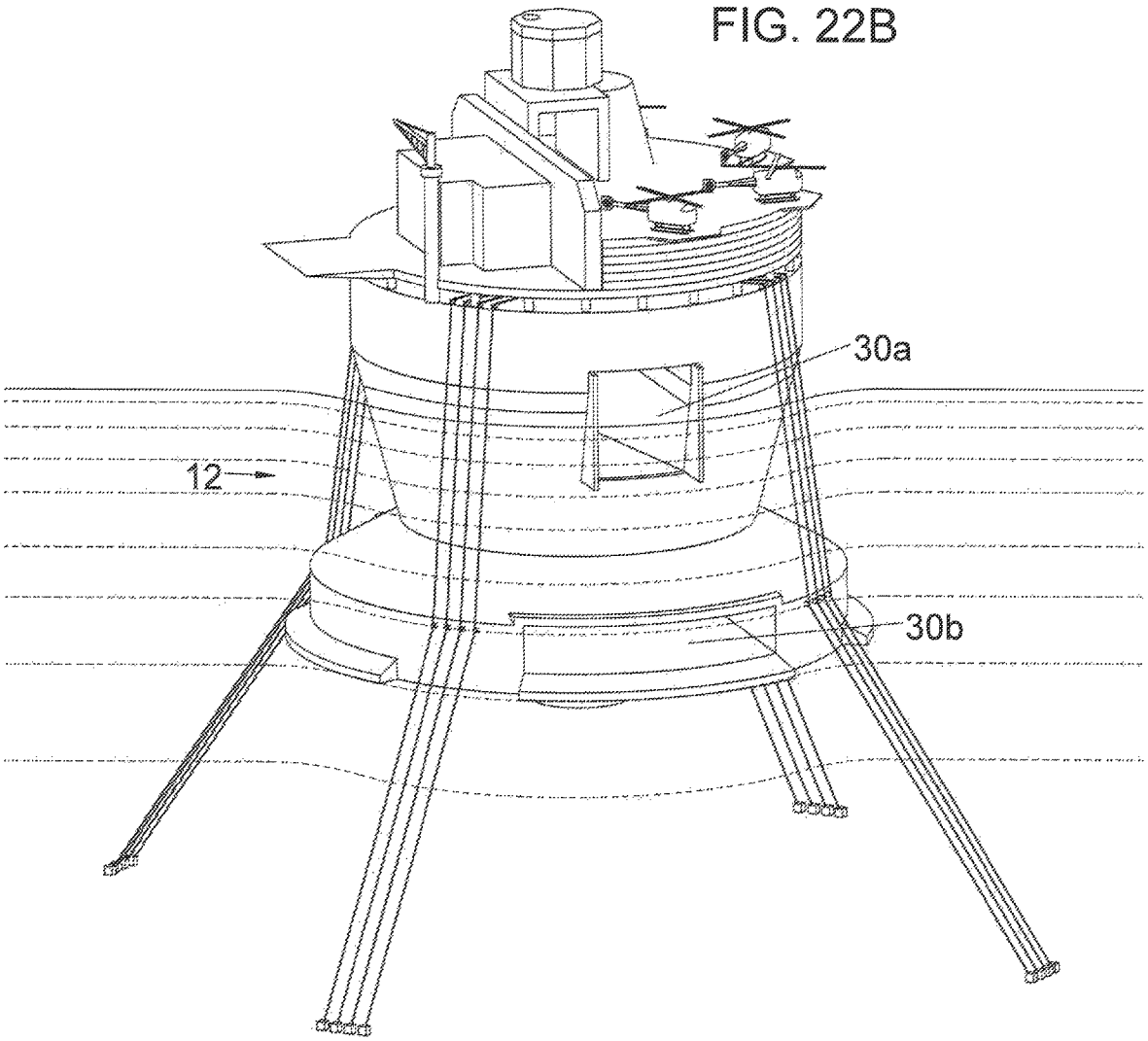

FIGS. 22A and 22B show the buoyant structure having a first tunnel 30*a* and a second tunnel 30*b* both tunnels containing water at operational depth 71.

In another embodiment, the buoyant structure can have one tunnel containing water and one tunnel containing no water.

In embodiments, tunnel 30*a* can be dry when the buoyant structure is at a transit depth 70.

FIG. 22A depicts tunnel 30*a* and 30*b* both filled with water at operational depth, but tunnel 30*a* being dry at transit depth with tunnel 30*b* being less full of water at transit depth for lower fuel costs while moving the buoyant structure.

While these embodiments have been described with emphasis on the embodiments, it should be understood that within the scope of the appended claims, the embodiments might be practiced other than as specifically described herein.

What is claimed is:

1. A buoyant structure comprising:

a. a hull having a main deck;

b. a lower inwardly-tapering frustoconical side section that extends from the main deck;

c. a lower generally round section extending from the lower inwardly-tapering frustroconical side section;

d. a keel having an n-polytope shape;

e. a plurality of separate tunnels formed in the hull, wherein the plurality of separate tunnels are configured to contain water at operational depth of the buoyant structure; and f. a fin-shaped appendage secured to a lower and an outer portion of the hull, the fin-shaped appendage having a shape selected from the group consisting of: triangular shape, a hump, and a pair of connected triangular projections.

2. The buoyant structure of claim 1, comprising an upper cylindrical side section extending from the main deck engaging the lower inwardly-tapering frustoconical side section.

3. The buoyant structure of claim 1, comprising a cylindrical neck connected between the lower inwardly-tapering frustoconical side section and the lower generally round section.

4. The buoyant structure of claim 1, wherein the hull is ballasted to move between a transport depth and an operational depth, and wherein the fin-shaped appendage is configured to dampen movement of the buoyant structure as the buoyant structure moves in water.

5. The buoyant structure of claim 1, comprising columns extending from the keel having an n-polytope shape.

6. The buoyant structure of claim 5, wherein a group of the columns are cylindrical.

7. The buoyant structure of claim 5, wherein a group of the columns have equal heights.

8. The buoyant structure of claim 5, wherein tunnels are formed between the groups of columns.

9. The buoyant structure of claim 8, wherein the tunnels are asymmetrically formed on the keel having an n-polytope shape.

10. The buoyant structure of claim 8, wherein the tunnels are symmetrically formed on the keel having an n-polytope shape.

11. The buoyant structure of claim 5, wherein the tunnels are asymmetrical in relationship to the keel having an n-polytope shape or asymmetrical between the columns.

12. The buoyant structure of claim 5, wherein the tunnels are symmetrical in relationship to the keel having an n-polytope shape or symmetrical between the columns.

13. The buoyant structure of claim 5, wherein each column has a combination of inward frustroconical flat panels and outward frustroconical flat panels.

14. The buoyant structure of claim 5, wherein each column has an outer wall having a shape that is curved.

15. The buoyant structure of claim 1, wherein tunnels, both contain water at operational depth, or one tunnel has water and one tunnel is dry.

16. The buoyant structure of claim 1, wherein one tunnel is dry at transit depth.

* * * * *